US010234776B2

(12) United States Patent
Maeda et al.

(10) Patent No.: US 10,234,776 B2
(45) Date of Patent: Mar. 19, 2019

(54) ELECTROPHOTOGRAPHIC PHOTORECEPTOR

(71) Applicant: Konica Minolta, Inc., Tokyo (JP)

(72) Inventors: Seisuke Maeda, Hussa (JP); Kazunori Kurimoto, Chofu (JP); Kazuhiro Kuramochi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/966,797

(22) Filed: Apr. 30, 2018

(65) Prior Publication Data

US 2018/0335707 A1 Nov. 22, 2018

(30) Foreign Application Priority Data

May 22, 2017 (JP) ..... 2017-101169

(51) Int. Cl.
*G03G 5/147* (2006.01)

(52) U.S. Cl.
CPC ..... *G03G 5/14704* (2013.01)

(58) Field of Classification Search
CPC ..... G03G 5/14704
See application file for complete search history.

(56) References Cited

U.S. PATENT DOCUMENTS

2003/0073015 A1* 4/2003 Tamoto ..... G03G 5/0507 430/66
2015/0241803 A1* 8/2015 Ikari ..... G03G 5/14 430/56
2017/0075236 A1* 3/2017 Kurachi ..... G03G 5/0507

FOREIGN PATENT DOCUMENTS

JP 2014186192 A 10/2014
JP 2014199391 A 10/2014
JP 2015099354 A 5/2015

* cited by examiner

*Primary Examiner* — Christopher D Rodee
(74) *Attorney, Agent, or Firm* — Lucas & Mercanti, LLP

(57) ABSTRACT

An electrophotographic photoreceptor has a charge generating layer, a charge transporting layer, and an outermost surface layer laminated in this order on a conductive support, wherein the outermost surface layer contains composite structural particles obtained by coating inorganic particles with oxygen-deficient conductive tin oxide, and the composite structural particles have an L value of 80 to 95, and primary particles thereof have an average particle diameter of 35 to 200 nm.

7 Claims, 3 Drawing Sheets

ELECTROPHOTOGRAPHIC PHOTORECEPTOR

The entire disclosure of Japanese patent Application No. 2017-101169, filed on May 22, 2017, is incorporated herein by reference in its entirety.

BACKGROUND

Technological Field

The present invention relates to an electrophotographic photoreceptor (hereinafter, also simply referred to as a "photoreceptor").

Description of the Related Art

As a charging method in an electrophotographic imaging process, a contact type charging method using a roller or the like (hereinafter, also referred to as a roller charging system) is used. The roller charging system is a charging system capable of charging at a low energy and uniform charging as compared with a charging system using a wire or the like (a scorotron charging system) and widely adopted.

For example, JP 2014-199391 A and JP 2015-099354 A adopt a roller charging system and tries to achieve both electrical characteristics and strength by causing an ultraviolet-curing resin to react with a charge-transporting agent capable of reacting therewith to be cured.

In a case where it is tried to achieve both electrical characteristics and mechanical strength, many studies to add conductive particles to a surface layer have been made. In discharging at the time of roller charging, a conductive filler serves a grounding point of discharging and can serve as a deteriorated site due to discharging. In order to reduce the number of deteriorated sites at the time of discharge, by adding conductive particles having a low volume resistance value and large particle diameters, it is possible to reduce the number of deteriorated sites due to discharging while the volume of the conductive particles in a surface layer is secured. Abrasion resistance can be obtained by using conductive particles having large particle diameters, but a dot diameter of a latent image is easily scattered, and it is difficult to obtain a delicate image.

For example, JP 2014-186192 A uses conductive particles having large particle diameters for an outermost surface layer. More specifically, JP 2014-186192 A discloses an electrophotographic photoreceptor having a surface layer containing composite barium sulfate fine particles having a number average primary particle diameter of 50 to 500 nm.

However, J P 2014-186192 A has not confirmed a dot diameter at the time of formation of a latent image. According to studies by the present inventors, it has been found that the dot diameter of the latent image is easily scattered during actual use in the photoreceptor described in JP 2014-186192 A. That is, it has been found that it may be difficult to obtain a delicate image in the photoreceptor described in JP 2014-186192 A.

SUMMARY

An object of the present invention is to provide a photoreceptor capable of achieving both electrical characteristics and mechanical strength (for example, abrasion resistance or scratch resistance), having no image blur, and capable of obtaining a delicate image.

To achieve the abovementioned object, according to an aspect of the present invention, an electrophotographic photoreceptor reflecting one aspect of the present invention has a charge generating layer, a charge transporting layer, and an outermost surface layer laminated in this order on a conductive support, wherein the outermost surface layer contains composite structural particles obtained by coating inorganic particles with oxygen-deficient conductive tin oxide, and the composite structural particles have an L value of 80 to 95, and primary particles thereof have an average particle diameter of 35 to 200 nm.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

{Image Forming Device}

An image forming device according to an embodiment of the present invention includes:

an electrophotographic photoreceptor having the following configuration;

a charger that charges a surface of the electrophotographic photoreceptor, an exposer that irradiates the charged surface of the electrophotographic photoreceptor with light to form an electrostatic latent image;

a developer that supplies a toner to the electrophotographic photoreceptor on which the electrostatic latent image is formed to form a toner image; and a transferer that transfers the toner image on the surface of the electrophotographic photoreceptor onto a recording medium, in which the charger is a proximity charging type charger (the above roller charging system) that applies a charging voltage by being close to (including a form of being in contact with) the surface of the electrophotographic photoreceptor.

Such a configuration is excellent in that discharge deterioration of a photoreceptor at the time of discharge is suppressed, that mechanical strength is excellent, and that a good image can be formed.

The image forming device according to an embodiment of the present invention uses a proximity charging type charger (roller charging system) that negatively charges a surface of an electrophotographic photoreceptor. In an image forming device including such a proximity charging type charger (roller charging system), a charging roller serving as the charger may be in contact with or close to a photoreceptor.

Figure 1:
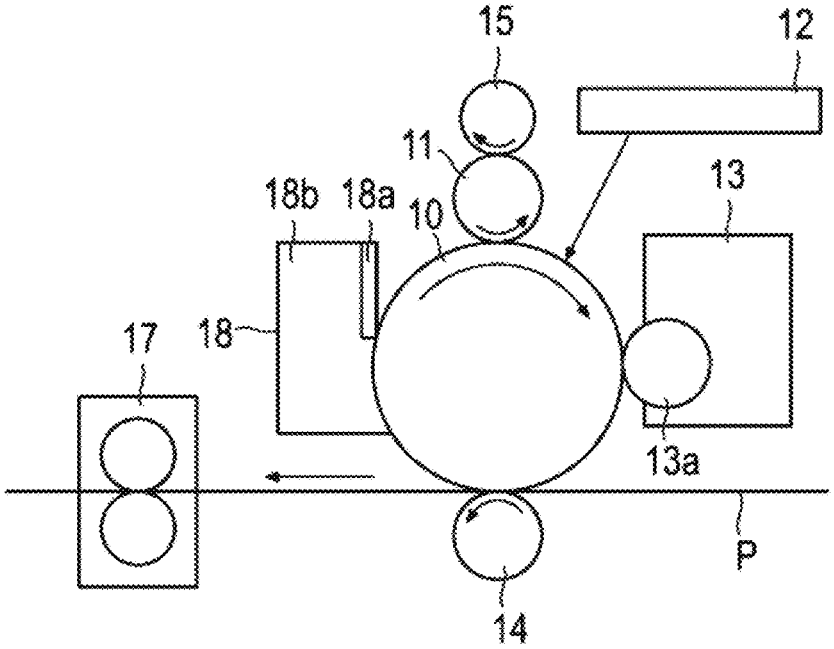
FIG. 1 is an explanatory cross-sectional view exemplifying the configuration of an image forming device according to an embodiment of the present invention.

FIG. 1 is an explanatory cross-sectional view exemplifying the configuration of an image forming device according to an embodiment of the present invention. The image forming device illustrated in FIG. 1 includes: a drum-shaped photoreceptor 10 serving as an electrostatic latent image support; a proximity charging type charger including a charging roller 11 that negatively charges a surface of the photoreceptor 10 uniformly by corona discharge or the like having the same polarity as a toner and a cleaning roller 15 that cleans the charging roller 11; an exposer 12 that performs image exposure on the uniformly charged surface of the photoreceptor 10 based on image data with a polygon mirror or the like to form an electrostatic latent image; a developer 13 that includes a rotating developing sleeve 13*a* and conveys a toner held on the developing sleeve 13*a* to the surface of the photoreceptor 10 to visualize the electrostatic latent image to form a toner image; a transferer 14 that transfers the toner image onto a transfer material P, if necessary; a fixer 17 that fixes the toner image on the transfer material P; and a cleaner 18 including a cleaning blade 18*a* that removes residual toner on the photoreceptor 10.

<<Electrophotographic Photoreceptor>>

An electrophotographic photoreceptor according to an embodiment of the present invention has a charge generating layer, a charge transporting layer, and an outermost surface layer laminated in this order on a conductive support, in which the outermost surface layer contains composite structural particles obtained by coating inorganic particles with oxygen-deficient conductive tin oxide, and the composite structural particles have an L value of 80 to 95, and primary particles thereof have an average particle diameter of 35 to 200 nm. With such a configuration, it is possible to provide a photoreceptor capable of achieving both mechanical strength and electrical characteristics, having no image blur, and capable of obtaining a delicate image. The photoreceptor according to an embodiment of the present invention also has high cleaning performance. Here, "cleaning performance" means easiness of removal of toner-derived deposits from a surface of a photoreceptor. "Mechanical strength" can be judged by evaluation of "cleaning performance" performed in Examples. That is, better cleaning performance makes it more difficult to form a scratch on a surface of an electrophotographic photoreceptor. This prevents occurrence of a trouble such as slipping of a toner, and it can be said that mechanical strength is excellent.

An exhibition mechanism or an action mechanism for obtaining the above effect by the electrophotographic photoreceptor according to an embodiment of the present invention is not clarified but is presumed as follows.

According to an embodiment of the present invention, it is possible to provide a photoreceptor that is highly resistant to discharge deterioration (that is, that has excellent "electrical characteristics"), has excellent mechanical strength, and can form a good image quality. In order to impart resistance to discharge, a cured film using a photopolymerization reaction and inorganic particles for imparting mechanical strength are added. However, the inorganic particles need to play a role for electrical characteristics simultaneously and need to have conductivity. In the present invention, in order to impart conductivity to the inorganic particles, the inorganic particles are coated with tin oxide.

The present inventors consider that it is preferable to adopt a core-shell structure for imparting conductivity to the inorganic particles. A charge is retained by the whole particle including the inside of a conductive particle. Therefore, a positive charge cannot cancel a negative charge present inside the conductive particle. Therefore, a negative charge is preferably present in a surface portion of the conductive particle in the conductive particle. Therefore, if a core portion is highly insulative as much as possible and conductivity is imparted to a shell portion, the conductive particle has a preferable configuration. A conductive particle having such a core-shell structure is also referred to as a "composite structural particle".

In order to maintain electrical characteristics and reduce the number of discharge points peculiar to AC roller charging in an outermost surface layer containing composite structural particles, by setting the diameters of the composite structural particles to 35 to 200 nm and reducing the addition amount of the composite structural particles, the number of discharge points can be reduced. However, in this case, the number is reduced. Therefore, in order to maintain the electrical characteristics, it is necessary to reduce a powder resistance of the composite structural particles to lower a resistance as the outermost surface layer. In a film having such a property, dots tend to be scattered when a latent image is formed, and a delicate image cannot be formed. In order to solve this problem, the present inventors made intensively studies and have found that it is necessary to adjust a volume resistance (resistivity) of tin oxide that coats inorganic particles and that this problem can be solved by adding composite structural particles having a volume resistance adjusted within a certain range by oxygen deficiency of tin oxide as a means. That is, it has been found that this problem can be solved by adding composite structural particles that coat inorganic particles with oxygen-deficient conductive tin oxide having a volume resistance within a certain range. Therefore, the present inventors adopted an "L value" in order to express the composite structural particles having a volume resistance within such a certain range more qualitatively and quantitatively. That is, it has been found that the above problem can be solved by using composite structural particles having an L value of 80 to 95. The "L value" represents the brightness of the color of conductive tin oxide and is used as an index representing the oxygen deficiency amount of the conductive tin oxide in the present invention. Incidentally, in the present invention, conductive tin oxide forms a shell layer of a composite structural particle, and therefore the physical properties (for example, L value, oxygen amount, and oxygen deficiency amount) of the conductive tin oxide as used herein also correspond to the physical properties of composite structural particles forming the conductive tin oxide.

Therefore, in the present invention, by using the above composite structural particles, it is possible to provide a photoreceptor suppressing discharge deterioration at the time of roller charging, capable of achieving both mechanical strength and electrical characteristics, having no image blur, and capable of obtaining a delicate image.

Hereinafter, the configuration of the electrophotographic photoreceptor according to an embodiment of the present invention will be described.

Figure 2:
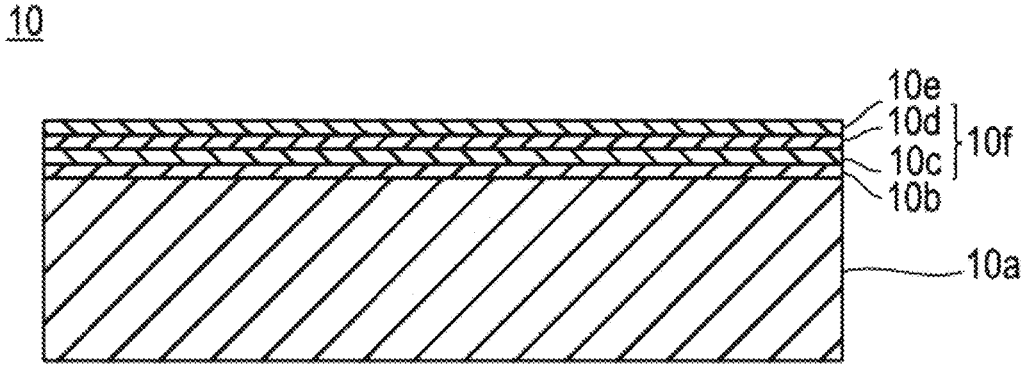
FIG. 2 is a partial cross-sectional view exemplifying the layer configuration of an electrophotographic photoreceptor constituting an image forming device according to an embodiment of the present invention.

In an electrophotographic photoreceptor having the layer configuration according to an embodiment of the present invention, for example, as illustrated in FIG. 2, an intermediate layer 10*b*, a charge generating layer 10*c*, a charge transporting layer 10*d*, and an outermost surface layer 10*e* are laminated in this order on a conductive support 10*a* to form a photoreceptor 10. The charge generating layer 10*c* and the charge transporting layer 10*d* constitute a photosensitive layer 10*f* indispensable for constituting the photoreceptor. The outermost surface layer 10*e* contains composite structural particles obtained by coating inorganic particles with oxygen-deficient conductive tin oxide.

<Outermost Surface Layer>

A layer constituting an outermost surface of the electrophotographic photoreceptor according to an embodiment of the present invention (that is, an outermost surface layer) essentially contains composite structural particles obtained by coating inorganic particles with oxygen-deficient conductive tin oxide. In addition, the outermost surface layer may contain, for example, a resin binder described later, if necessary. Each component of the outermost surface layer will be described below.

[Composite Structural Particles]

In the present invention, the composite structural particle contained in the outermost surface layer contains an inorganic particle as a core (also referred to as a "core material") and is obtained by coating the inorganic particle with oxygen-deficient conductive tin oxide.

(Inorganic Particles)

The composite structural particle according to an embodiment of the present invention contains an inorganic particle as a core. By using the inorganic particle as a core, it is possible to impart mechanical strength to the outermost surface layer and increase surface hardness, and abrasion resistance and scratch resistance of the outermost surface layer are improved. Furthermore, the inorganic particle preferably can suppress an increase in residual potential and generation of an image memory on a surface of the outermost surface layer. In addition, the inorganic particle preferably has a small relative dielectric constant and has an advantage that chargeability of the outermost surface layer can be secured from a viewpoint of electrostatic characteristics. Furthermore, the inorganic particle preferably has a small specific gravity, does not settle in an application liquid, and can improve manufacturing stability of the outermost surface layer. Examples of the inorganic particle include barium sulfate ($BaSO_4$), silicon dioxide (silica; $SiO_2$), aluminum oxide (alumina; $Al_2O_3$), titanium oxide (titania; $TiO_2$), zinc oxide (ZnO), copper oxide (CuO), and cerium oxide (ceria; $CeO_2$) from a viewpoint of imparting mechanical strength or the like as described above. These compounds may be used singly or in combination of two or more kinds thereof. A commercially available product or a synthetic product may be used for these inorganic particles. Those described below are preferable. That is, the composite structural particle is a conductive particle exhibiting n-type conductivity. A positive charge cannot cancel a negative charge inside the n-type conductive particle. Therefore, a charge on the conductive particle needs to be supported on a surface of the conductive particle. Therefore, the core used for the composite structural particle is preferably an inorganic particle having no conductivity. The inorganic particle is preferably formed of any one selected from the group consisting of $BaSO_4$, $SiO_2$, and $Al_2O_3$ from a viewpoint of transparency after the outermost surface layer is formed. The phrase "having no conductivity" as used herein means that the resistivity is, for example, $10^{12}$ Ω·cm or more. Note that the resistivity of the inorganic particles serving as a core can be measured in a similar manner to the volume resistivity of the composite structural particles described later.

An average particle diameter of primary particles of the inorganic particles serving as a core is preferably within a range of 10 to 200 nm, more preferably within a range of 15 to 150 nm, still more preferably within a range of 30 to 120 nm, and particularly preferably within a range of 50 to 100 nm from a viewpoint of adding particles having large particle diameters and reducing the number of discharge points in order to impart mechanical strength, to further maintain electrical characteristics, and to reduce the number of discharge points as described above. If the average particle diameter is 10 nm or more, the amount of the inorganic particles contained in the outermost surface layer of the photoreceptor does not become too large (within a range where the amount of the composite structural particles having the inorganic particles as a core material is 50 to 250 parts by mass with respect to 100 parts by mass of a resin binder), and the number of discharge points can be reduced. Therefore, the inorganic particles having such an average particle diameter are excellent in being capable of imparting sufficient film strength against discharge. The average particle diameter of the primary particles of the inorganic particles of 200 nm or less is excellent in that the content of the inorganic particles in the outermost surface layer of the photoreceptor does not become too small and that electrical characteristics as the photoreceptor can be sufficiently satisfied. Note that the average particle diameter (average primary particle diameter) of the primary particles can be measured by volume-based particle diameter measurement of particles by a laser diffraction method. The average particle diameter (average primary particle diameter) of other particles, for example, composite structural particles, can also be measured in a similar manner to the above.

In the present invention, the content of the inorganic particles is preferably 20 to 90% by mass, and more preferably 30 to 70% by mass with respect to the total amount of the composite structural particles. Within this range, the effect according to an embodiment of the present invention can be obtained more efficiently. Note that the term "composite structural particles" as used herein refers to a form contained in the outermost surface layer of the photoreceptor. For example, in a case where a surface treatment and/or fluorocarbon resin coating described later is performed, the term "composite structural particles" refers to composite structural particles which have been subjected to the surface treatment and/or fluorocarbon resin coating. In a case where the surface treatment and/or fluorocarbon resin coating is not performed, the term "composite structural particles" refers to composite structural particles which have not been subjected to the surface treatment and/or fluorocarbon resin coating.

(Conductive Tin Oxide)

In the present invention, the composite structural particles are obtained by coating inorganic particles with conductive tin oxide. The conductive tin oxide is an oxygen deficient type, that is, only needs to have an L value of the composite structural particles within a range of 80 to 95.

The oxygen-deficient conductive tin oxide can be manufactured by, for example, coating a tin source compound with inorganic particles serving as a core and then firing the resulting product when composite structural particles described later are manufactured.

(Manufacture of Composite Structural Particles)

In the present invention, a method for manufacturing the composite structural particles is not particularly limited, and a known method can be appropriately used. For example, the composite structural particles can be manufactured by the following method.

First, inorganic particles serving as a core are dispersed in a medium to prepare a slurry. Here, as the core, the above-described inorganic particles can be used. As the medium, an appropriate liquid is selected according to the kind of the core, a reaction for forming a coating layer of a tin source compound, and the like. Generally, water is used.

As a blending ratio between the medium and the core in the slurry, the content of the core is preferably 40 g or more and 250 g or less, and particularly preferably 50 g or more and 200 g or less with respect to 1 liter of the medium. This is because a uniform coating layer of a tin source compound is easily formed on a surface of the core if the blending ratio between the two is within this range.

A tin source compound is added to the obtained slurry. The tin source compound is not particularly limited as long as being able to attach a tin-containing precipitate to a surface of the core, and preferable examples thereof include an aqueous solution of a tin compound such as sodium stannate, tin tetrachloride, potassium stannate, or tin tetrabromide.

As a blending ratio between the medium and the tin source compound in the slurry, the content of Sn in the tin source compound with respect to 100 parts by mass of the medium is preferably 1 part by mass or more and 20 parts by mass or less, and particularly preferably 3 parts by mass or more and 10 parts by mass or less. The blending ratio between the two within this range is preferable because a uniform coating layer of a tin-containing precipitate is easily formed on a surface of the core.

Subsequently, the pH of the mixed slurry to which the tin source compound has been added is adjusted. The pH is adjusted by adding an acid or a base. A neutralization reaction of the tin source compound is performed by this pH adjustment. Examples of a method for performing the neutralization reaction include a method for adding an acidic substance or a basic substance to the slurry. Examples of the acidic substance include sulfuric acid, nitric acid, and acetic acid. In a case where sulfuric acid is used, if dilute sulfuric acid is used, it is easy to obtain a uniform coated product or coating layer of tin oxide. The concentration of the dilute sulfuric acid is usually 10 to 50% by volume. Examples of the basic substance include sodium hydroxide and ammonia water. Among these compounds, sodium hydroxide is preferable because the concentration thereof is easily controlled. By the neutralization reaction of the tin source compound, a tin-containing precipitate is generated on a surface of the core material, and precipitate-adhering particles are obtained. The pH of the mixed slurry after the adjustment is preferably 0.5 or more and 5 or less, more preferably 2 or more and 4 or less, and still more preferably 2 or more and 3 or less.

Subsequently, the generated precursor of composite structural particles is cleaned with water and dried. Then, the dried precursor of conductive particles is fired. In this case, in a case where oxygen-deficient conductive tin oxide is generated, it is advantageous to use a non-oxidizing atmosphere as a firing atmosphere. Examples of the non-oxidizing atmosphere include a nitrogen atmosphere, a nitrogen atmosphere containing hydrogen at a concentration lower than an explosion limit, and an inert gas atmosphere such as argon. Among these atmospheres, a nitrogen atmosphere containing hydrogen is preferable from an industrial viewpoint because of being inexpensive. In a case where a nitrogen atmosphere containing hydrogen is used, the concentration of hydrogen is preferably 0.1% by volume or more and 10% by volume or less, and more preferably 1% by volume or more and 3% by volume or less as a concentration lower than an explosion limit. This is because the concentration of hydrogen within this range easily forms a coating layer of oxygen-deficient conductive tin oxide without reducing tin to a metal.

The firing temperature is preferably 300° C. or higher and 800° C. or lower, and more preferably 400° C. or higher and 700° C. or lower. The firing time is preferably 20 minutes or more and 120 minutes or less, and more preferably 30 minutes or more and 100 minutes or less. This is because the firing temperature and time within these ranges are sufficient for generating oxygen deficiency in tin oxide and hardly cause aggregation. By performing this firing, desired composite structural particles are obtained.

In the present invention, the L value of the composite structural particles is 80 to 95, and preferably 85 to 90 from a viewpoint of further exhibiting the effect according to an embodiment of the present invention. The L value can be measured by a method described in Examples. In the photoreceptor according to an embodiment of the present invention, the L value can be measured also by a destructive test after an outermost surface layer containing the composite structural particles having the L value within the above range is formed.

That is, the photoreceptor is set in a driving machine equipped with a rotating jig, a wrapping film having a roughness of 3 μm is pressed against the photoreceptor, and the photoreceptor is driven for one hour at a rotational speed of 200 rpm. After driving, abrasion powder of the outermost surface layer obtained from a surface of the photoreceptor is collected, and the L value of the composite structural particles can be measured by a measurement method described in Examples.

Incidentally, basically, it is assumed that the L value of the composite structural particles does not change among a state of the material, a state of the surface layer of the photoreceptor, and a state of the abrasion powder collected from the outermost surface layer.

In the present invention, the volume resistivity of the composite structural particles is preferably $10^3$ to $10^7$ [Ω·cm], and more preferably $10^4$ to $10^6$ [Ω·cm] at 25° C. By setting the volume resistivity within the above range, it is possible to satisfy electrical characteristics required for the photoreceptor, and it is possible to obtain a delicate image without image blur.

The volume resistance is measured, for example, using a powder resistance measurement system (Mitsubishi Chemical PD-41) and a resistivity measuring device (Mitsubishi Chemical MCP-T600). 15 g of a sample (composite structural particles) is input into a probe cylinder, and a probe unit is set on PD-41. A resistance value when a pressure of 500 kgf/cm$^2$ is applied by a hydraulic jack is measured using MCP-T600. A powder resistance (volume resistivity) is calculated from the measured resistance value and the thickness of the sample. As the timing of the measurement, it is only required to perform the measurement for a form of the composite structural particles contained in the outermost surface layer of the photoreceptor. For example, in a case where a surface treatment and/or fluorocarbon resin coating is not performed, it is only required to perform the measurement after formation of composite structural particles which have not been subjected to these treatments. In a case where the surface treatment (silane coupling agent treatment) and/or fluorocarbon resin coating is performed after formation of the composite structural particles, it is only required to perform the measurement after the surface treatment (silane coupling agent treatment) and/or fluorocarbon resin coating. The measurement method can be used similarly in both the forms.

In the present invention, an average particle diameter of primary particles of the composite structural particles is 35 to 200 nm, preferably 50 to 200 nm, more preferably 80 to 150 nm, and particularly preferably 100 to 120 nm from a viewpoint of adding particles having large particle diameters and reducing the number of discharge points in order to impart mechanical strength, to further maintain electrical characteristics, and to reduce the number of discharge points as described above. If the average particle diameter of the primary particles of the composite structural particles is less than 35 nm, the amount of the composite structural particles contained in the outermost surface layer of the photoreceptor is large, and the number of discharge points is large. Therefore, the strength of the film (outermost surface layer) against discharge is deteriorated. If the average particle diameter of the primary particles of the composite structural particles is more than 200 nm, the content of the composite structural particles in the outermost surface layer is small, and electrical characteristics as the photoreceptor cannot be satisfied. The average particle diameter (average primary particle diameter) of the primary particles is measured for composite structural particles which have not been subjected to a surface treatment and/or fluorocarbon resin coating described later irrespective of performing the surface treatment and/or fluorocarbon resin coating. Incidentally, even if the composite structural particles are subjected to a surface treatment and/or fluorocarbon resin coating described later, it is considered that a change in thickness is within an error range with respect to the size of each of the composite structural particles (roughly, the thickness of about 1/10000 with respect to the diameter of each of the composite structural particles). Therefore, it is assumed that there is no change in the average primary particle diameter by performing the surface treatment and/or fluorocarbon resin coating.

In a case where the outermost surface layer of the photoreceptor is analyzed and the average particle diameter (number average primary particle diameter) of the primary particles of the inorganic particles is calculated, calculation can be performed as follows. An enlarged photograph of a cut surface of the outermost surface layer of the photoreceptor at a magnification of 10000 times is taken with a scanning electron microscope (manufactured by JEOL Ltd.), and randomly selected 300 composite structural particles are captured by a scanner to obtain a photographic image (except for aggregated particles), and calculation therefor can be performed using an automatic image processing analyzer LUZEX AP (manufactured by Nireco Corporation) and Software Version Ver. 1.32. Even in this case, the average particle diameter (number average primary particle diameter) of the primary particles is measured for composite structural particles (inorganic substance) not containing a treated film or coated film (organic substance) portion formed by a surface treatment and/or fluorocarbon resin coating irrespective of performing the surface treatment and/or fluorocarbon resin coating.

(Composite Structural Particles Surface-Treated with Surface Treatment Agent)

In the present invention, the composite structural particles are preferably surface-treated with a surface treatment agent from a viewpoint of dispersibility, and more preferably surface-treated with a surface treatment agent having a reactive organic group.

In a case where the amount of oxygen in conductive tin oxide is controlled, the amount of hydroxy groups on a surface of conductive tin oxide varies. A hydroxy group on the surface of conductive tin oxide can serve as a bonding point of a surface treatment agent. Therefore, there is a possibility that a sufficient surface treatment is not performed due to variation of the hydroxy group. The surface treatment agent acts as a reaction point during a photocuring reaction, contributes to improvement of hardness of the outermost surface layer, enhances affinity to a solvent, and contributes to securing dispersibility of the particles.

As the surface treatment agent, it is preferable to use a surface treatment agent that reacts with a hydroxy group or the like present on a surface of the composite structural particle before a treatment, and examples of the surface treatment agent include a silane coupling agent and a titanium coupling agent.

In the present invention, in order to further increase the hardness of the outermost surface layer of the photoreceptor, it is preferable to use a surface treatment agent having a reactive organic group, and it is more preferable to use a surface treatment agent in which the reactive organic group is a polymerizable reactive group. By using a surface treatment agent having a polymerizable reactive group, in a case where a resin binder is a polymerized cured product (cured resin) of a polymerizable compound described below, the surface treatment agent also reacts with the polymerizable compound, and therefore a strong protective film can be formed.

The surface treatment agent having a polymerizable reactive group is preferably a silane coupling agent having an acryloyl group or a methacryloyl group. That is, the composite structural particles according to an embodiment of the present invention are preferably surface-treated with a silane coupling agent containing an acryloyl or methacryloyl group. By performing a surface treatment with a surface treatment agent such as a silane coupling agent containing an acryloyl or methacryloyl group, the composite structural particles are covalently bonded to each other via a resin binder and a surface treatment agent to form a strong outermost surface layer.

Examples of the silane coupling agent having an acryloyl group or a methacryloyl group include the following compounds.

$CH_2{=}CHCOO(CH_2)_2Si(CH_3)(OCH_3)_2$ S1:

$CH_2{=}CHCOO(CH_2)_2Si(OCH_3)_3$ S2:

$CH_2{=}CHCOO(CH_2)_2Si(OC_2H_5)(OCH_5)_2$ S3:

$CH_2{=}CHCOO(CH_2)_3Si(OCH_3)_3$ S4:

$CH_2{=}CHCOO(CH_2)_2Si(CH_3)Cl_2$ S5:

$CH_2{=}CHCOO(CH_2)_2SiCl_8$ S6:

$CH_2{=}CHCOO(CH_2)_2Si(CH_3)Cl_2$ S7:

$CH_2{=}CHCOO(CH_2)_3SiCl_3$ S8:

$CH_2{=}C(CH_3)COO(CH_2)_2Si(CH_3)(OCH_3)_2$ S9:

$CH_2{=}C(CH_3)COO(CH_2)_2Si(OCH_3)_3$ S10:

$CH_2{=}C(CH_3)COO(CH_2)_3Si(CH_3)(OCH_3)_2$ S11:

$CH_2{=}C(CH_3)COO(CH_2)_3Si(OCH_3)_3$ S12:

$CH_2{=}C(CH_3)COO(CH_2)_2Si(CH_3)Cl_2$ S13:

$CH_2{=}C(CH_3)COO(CH_2)_2SiCl_3$ S14:

$CH_2{=}C(CH_3)COO(CH_2)_3Si(CH_3)Cl_2$ S15:

$CH_2{=}C(CH_3)COO(CH_2)_3SiCl_3$ S16:

$CH_2{=}CHCOOSi(OCH_3)_3$ S17:

$CH_2{=}CHCOOSi(OC_2H_5)_3$ S18:

$CH_2{=}C(CH_3)COOSi(OCH_3)_3$ S19:

$CH_2{=}C(CH_3)COOSi(OC_2H_5)_3$ S20:

$CH_2{=}C(CH_3)COO(CH_2)_3Si(OC_2H_5)_3$ S21:

$CH_2{=}CHCOO(CH_2)_2Si(CH_3)_2(OCH_3)$ S22:

$CH_2{=}CHCOO(CH_2)_2Si(CH_3)(OCOCH_3)_2$ S23:

$CH_2{=}CHCOO(CH_2)_2Si(CH_3)(ONHCH_3)_2$ S24:

$CH_2{=}CHCOO(CH_2)_2Si(CH_3)(OC_6H_5)_2$ S25:

$CH_2{=}CHCOO(CH_2)_2Si(C_{10}H_{21})(OCH_3)_2$ S26:

$CH_2{=}CHCOO(CH_2)_2Si(CH_3C_6H_5)(OCH_3)_2$ S27: [Chemical formula 1]

As the surface treatment agent, in addition to the above chemical formulas S1 to S27, a silane compound having a reactive organic group capable of performing a polymerization reaction can be used. These surface treatment agents can be used singly or in mixture of two or more kinds thereof.

As such a surface treatment agent, a synthetic product or a commercially available product may be used. Examples of the commercially available product include silane coupling agents KBM-502, KBM-503, KMB-5103, and KBE-503 manufactured by Shin-Etsu Chemical Co. but are not limited thereto.

The use amount of the surface treatment agent is not particularly limited but is preferably 0.5 to 10 parts by mass, and more preferably 1 to 6 parts by mass with respect to 100 parts by mass of the composite structural particles before a treatment. That is, it can be said that the composite structural particles are preferably surface-treated (a surface-treated film is formed) with a surface treatment agent within a range of 0.5 to 10 parts by mass with respect to 100 parts by mass of the composite structural particles before a treatment. Furthermore, the composite structural particles are more preferably surface-treated (a surface-treated film is formed) with a surface treatment agent having a polymerizable reactive group within a range of 1 to 6 parts by mass with respect to 100 parts by mass of the composite structural particles before a treatment. Within this range, the effect according to an embodiment of the present invention can be obtained more efficiently. If the amount of the surface treatment agent having a polymerizable reactive group is 0.5 parts by mass or more with respect to 100 parts by mass of the composite structural particles before a treatment, a crosslinked structure can be formed between a resin binder and the composite structural particles at the time of curing, and this is preferable. Meanwhile, if the amount of the surface treatment agent having a polymerizable reactive group is 10 parts by mass or less with respect to 100 parts by mass of the composite structural particles before a treatment, an excessive surface treatment agent does not remain in the surface layer, an image quality is not affected, and this is preferable. Note that the term "composite structural particles before a treatment" refers to composite structural particles which have not been subjected to a surface treatment or coating with a surface treatment agent, a fluorocarbon resin, or the like. In addition, the silane coupling agent (surface treatment agent), the fluorocarbon resin, and the use amounts thereof (the contents of a surface-treated film and a fluorocarbon resin film derived from a silane coupling agent and a fluorocarbon resin) can be determined by peeling the outermost surface layer of the photoreceptor and performing analysis using X-ray photoelectron spectroscopy.

The surface treatment of the composite structural particles is not particularly limited and can be performed by a known method. A wet or dry surface treatment method can be adopted. In the dry surface treatment method, a surface treatment solution obtained by dissolving an organic surface treatment agent in a solvent is sprayed onto target particles (that is, composite structural particles before a surface treatment) dispersed in a cloud shape by stirring or the like, or a vaporized surface treatment solution is brought into contact with and attached to the target particles. In the wet surface treatment method, for example, target particles are added to a surface treatment solution obtained by dissolving or dispersing an organic surface treatment agent in an organic solvent, followed by mixing and stirring, or target particles are dispersed in a surface treatment solution, and an organic surface treatment agent is dropped into the dispersion, followed by stirring. Thereafter, the solvent is removed from the resulting dispersion by distillation under reduced pressure or the like, and the obtained particles are heated and dried to obtain surface-treated composite structural particles. Among these methods, the wet surface treatment is preferably performed because of low complexity.

As a solvent for preparing the surface treatment solution, an organic solvent is preferably used. Examples of the organic solvent include an alcohol-based solvent such as methanol, ethanol, n-propyl alcohol, isopropyl alcohol, n-butanol, t-butanol, or sec-butanol, an aromatic hydrocarbon-based solvent such as benzene, toluene, or xylene, and an ether-based solvent such as tetrahydrofuran or dioxane but are not limited thereto.

Mixing and stirring in the wet surface treatment method only need to be performed appropriately until target particles are sufficiently dispersed. The temperature during the treatment is preferably about 15 to 100° C., and more preferably 20 to 50° C. The treatment time is preferably 30 seconds to 10 hours, and more preferably 1 minute to 5 hours. The temperature during heating and drying can be, for example, 80 to 220° C., and preferably 100 to 150° C. The time for heating and drying is not particularly limited, and is, for example, preferably 0.5 to 10 hours, and more preferably 1 to 5 hours. Note that these conditions are merely examples and may vary depending on a treatment device. Therefore, it is not necessary to perform the treatment within the above-described ranges.

In the wet surface treatment method, the use amount of a surface treatment agent (for example, silane coupling agent) varies depending on the kind thereof. However, for example, the surface treatment agent can be used in an amount of 0.1 to 20 parts by mass, more preferably 1 to 15 parts by mass with respect to 100 parts by mass of target particles. The addition amount of a solvent is preferably 100 to 600 parts by mass, and more preferably 200 to 500 parts by mass with respect to 100 parts by mass of target particles.

A method for mixing and stirring is not particularly limited, and a known method can be adopted. For example, mixing and stirring can be performed by a mixer with a chamber.

(Composite Structural Particles Coated with Fluorocarbon Resin)

In the present invention, the composite structural particles are preferably coated with a fluorocarbon resin, and more preferably coated with a fluorocarbon resin after the surface treatment with the surface treatment agent. By applying a fluorocarbon resin treatment which can be expected to exhibit an effect as a surfactant onto a surface, uniform dispersibility in the outermost surface layer can be exhibited. In addition, by applying the fluorocarbon resin treatment, the frictional resistance of the particles themselves is lowered, and a high cleaning performance function can be constantly exhibited and maintained in the outermost surface layer through durability as compared with a case where the fluorocarbon resin type surface treatment is not performed.

The fluorocarbon resin is not particularly limited, and a conventionally known fluorocarbon resin can be used. For example, the fluorocarbon resin may be used in a form of a copolymer (in a form of a fluorocarbon resin) obtained by copolymerizing a fluoroaliphatic group-containing unsaturated ester monomer and an unsaturated silane monomer-containing monomer described in JP 2002-146271 A or in a form of a coating composition containing the copolymer (in a form of a coating agent). Alternatively, the fluorocarbon resin may be used in a form of a fluoroalkyl (meth)acrylate/(meth)acrylic acid copolymer (in a form of a fluorocarbon resin) described in JP 2013-028807 A or in a form of a coating composition containing the copolymer and a partially fluorinated solvent (in a form of a coating agent). In this case, the fluoroalkyl group has 6 or less carbon atoms. In a case where the fluoroalkyl group is a perfluoroalkyl group, a copolymer containing 5% by weight or less of (meth)acrylic acid or the like can be used as the copolymer. A fluorocarbon resin contained in the form of a fluorocarbon resin or a coating agent preferably contains a fluorinated methacrylic acid polymer segment such as a fluoroalkyl (meth)acrylate/(meth)acrylic acid copolymer. This is because the effect of coating the composite structural particles with the fluorocarbon resin can be further improved by inclusion of the fluorinated methacrylic acid polymer segment in the fluorocarbon resin. However, the fluorocarbon resin (including a form of a coating agent) used in the present invention is not limited to the above resins. As the fluorocarbon resin (including a form of a coating agent), a synthetic product or a commercially available product may be used. Examples of the commercially available product include fluorine-based coating agents Novec (registered trademark) 2702, Novec 1700, and Novec 1720 manufactured by 3M Company, but are not limited thereto. As described above, the fluorocarbon resin (coating agent) such as the fluorine-based coating agent Novec (registered trademark) 2702 contains a solvent in addition to the fluorocarbon resin. However, as described in Examples, by mixing (=including drying and removal of a solvent) the composite structural particles and the fluorocarbon resin (Novec (registered trademark) 2702 or the like), the composite structural particles can be coated with the fluorocarbon resin (a fluorocarbon resin film can be formed).

The use amount of the fluorocarbon resin (including a form of a coating agent) (the use amount of a solid content) is not particularly limited but is preferably within a range of 1 to 10 parts by mass, and more preferably within a range of 3 to 6 parts by mass with respect to 100 parts by mass of the composite structural particles before a treatment. That is, the composite structural particles are coated with a fluorocarbon resin (a fluorocarbon resin film is formed) within a range preferably of 1 to 10 parts by mass, more preferably of 3 to 6 parts by mass with respect to 100 parts by mass of the composite structural particles before a treatment. Within this range, the effect according to an embodiment of the present invention can be obtained more efficiently. If the amount of the fluorocarbon resin is 1 part by mass or more with respect to 100 parts by mass of the "composite structural particles before a treatment", a surface coating property of the composite structural particles is sufficiently obtained, and hydrophilization of surfaces of the composite structural particles at the time of discharge can be suppressed. Therefore, even under a high temperature and high humidity environment, a charge can be sufficiently retained, and a good image can be formed. If the amount of the fluorocarbon resin is 10 parts by mass or less, a coating property to the composite structural particles is sufficiently obtained, and deterioration of a charge passing property by a fluorocarbon resin having a high insulating property can be effectively suppressed. Therefore, a necessary potential can be sufficiently obtained after exposure of the photoreceptor, and a good image can be formed. Note that the term "composite structural particles before a treatment" refers to composite structural particles not coated with a fluorocarbon resin. That is, the composite structural particles before a treatment only need to be composite structural particles in which inorganic particles themselves are coated with oxygen-deficient conductive tin oxide, and the composite structural particles may be surface-treated with a surface treatment agent.

The surface treatment of the composite structural particles with a fluorocarbon resin is not particularly limited, and a conventionally known method can be used. Examples thereof include a method for applying a coating composition (in a form of a fluorocarbon resin or a coating agent) described in JP 2002-146271 A and an applying method (coating method) with a coating composition (in a form of a fluorocarbon resin or a coating agent) described in JP 2013-028807 A.

(Configuration of Composite Structural Particle)

Figure 4A:
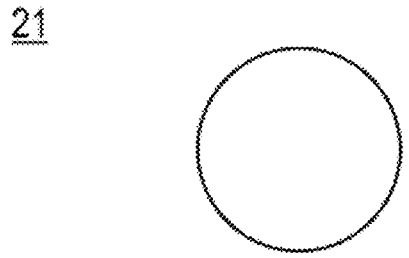
FIGS. 4A to 4D are explanatory cross-sectional views exemplifying the configuration of a composite structural particle contained in an outermost surface layer of an electrophotographic photoreceptor according to an embodiment of the present invention and a particle structure in a process of manufacturing the composite structural particle.
Figure 4B:
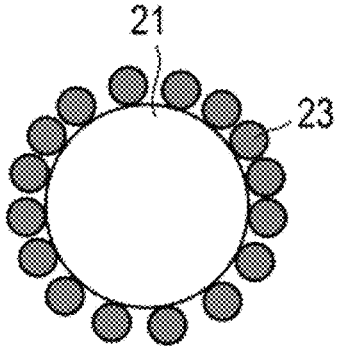
Figure 4C:
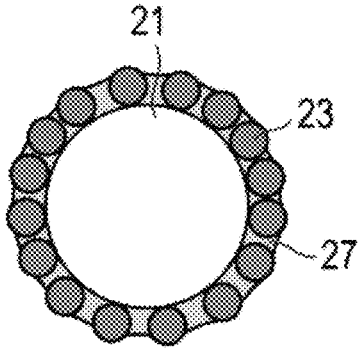
Figure 4D:
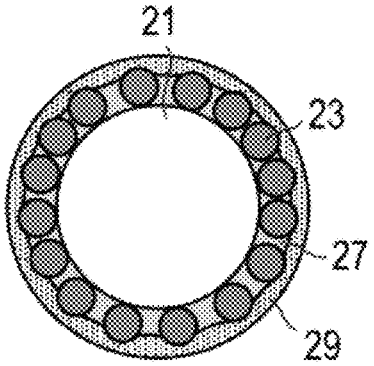

FIGS. 4A to 4D are explanatory cross-sectional views exemplifying a configuration of a composite structural particle contained in an outermost surface layer of an electrophotographic photoreceptor constituting the image forming device according to an embodiment of the present invention and a particle structure in a process of manufacturing the composite structural particle. FIG. 4A is an explanatory cross-sectional view exemplifying a structure of an inorganic particle serving as a core prepared in a process of manufacturing the composite structural particle. FIG. 4B is an explanatory cross-sectional view exemplifying a structure of a composite structural particle in which the inorganic particle of FIG. 4A is coated with oxygen-deficient conductive tin oxide. FIG. 4C is an explanatory cross-sectional view exemplifying a structure of a composite structural particle obtained by surface-treating the composite structural particle of FIG. 4B with a surface treatment agent. FIG. 4D is an explanatory cross-sectional view exemplifying a structure of a composite structural particle obtained by coating the composite structural particle surface-treated with a surface treatment agent in FIG. 4C with a fluorocarbon resin. FIG. 4A illustrates the cross section of an inorganic particle 21 used for a core. The form of FIG. 4B illustrates the cross-section of a composite structural particle 25 in which the core (inorganic particle) 21 is coated with oxygen-deficient conductive tin oxide 23. In the composite structural particle according to an embodiment of the present invention, like the form illustrated in FIG. 4B, the entire surface of the core (inorganic particles) 21 does not need to be coated with the oxygen-deficient conductive tin oxide 23. In the present invention, the outermost surface layer of the photoreceptor may contain the composite structural particle 25 or may contain the following surface-treated composite structural particle. The form of FIG. 4C illustrates the cross section of a composite structural particle 25*a* obtained by surface-treating the surface of the composite structural particle 25 of FIG. 4B with a surface treatment agent. The surface of the composite structural particle 25 includes the surface of the inorganic particle 21 (a gap between the oxygen-deficient conductive tin oxide 23 coated products (granular products) and the like) in addition to the surface of the oxygen-deficient conductive tin oxide 23. By the surface treatment described above, the surface of the composite structural particle 25 (the inorganic particle 21 and the oxygen-deficient conductive tin oxide 23 coating the inorganic particle 21) is coated with the surface treatment agent (a surface-treated film 27 is formed). The form of FIG. 4D illustrates the cross section of a composite structural particle 25*b* obtained by coating the surface-treated composite structural particle 25*a* of FIG. 4C (the surfaces of the surface-treated inorganic particle 21 of FIG. 4C and the surface-treated oxygen-deficient conductive tin oxide 23 of FIG. 4C and the like) with a fluorocarbon resin. By coating with a fluorocarbon resin, the surface of the surface-treated composite structural particle 25*a* of FIG. 4C (the surfaces of the surface-treated inorganic particle 21 of FIG. 4C and the surface-treated oxygen-deficient conductive tin oxide 23 of FIG. 4C and the like) is coated with the fluorocarbon resin (a fluorocarbon resin film 29 is formed). A ratio between the size of the inorganic particle 21 and the size of the oxygen-deficient conductive tin oxide 23 coated product (granular product) 23 is set to be substantially the same as a ratio between the actual sizes used in Examples.

[Resin Binder]

The outermost surface layer of the photoreceptor according to an embodiment of the present invention preferably further contains a resin binder in addition to the composite structural particles. In a case of containing a resin binder, the content of the composite structural particles is preferably within a range of 50 to 250 parts by mass, and more preferably within a range of 70 to 200 parts by mass with respect to 100 parts by mass of the resin binder. Within such a range, the effect according to an embodiment of the present invention can be obtained more efficiently. If the content of the composite structural particles is 50 parts by mass or more with respect to that of the resin binder, sufficient resistance to discharge can be obtained. Furthermore, presence of a conductive portion (=composite structural particles) serving as a path of a charge in the outermost surface layer does not become too small, deterioration of a charge passing property can be effectively prevented, and a necessary potential can be obtained after exposure. Meanwhile, if the content of the composite structural particles is 250 parts by mass or less, there is no excessive presence of the composite structural particles in the outermost surface layer, an increase in the number of discharge points at the time of discharge is suppressed, and a decrease in resistance to discharge can be effectively prevented. Note that the term "composite structural particles" as used herein refers to a form contained in the outermost surface layer of the photoreceptor. For example, in a case where the above-described surface treatment and/or fluorocarbon resin coating is performed, the term "composite structural particles" refers to composite structural particles which have been subjected to the surface treatment and/or fluorocarbon resin coating. In a case where the surface treatment and/or fluorocarbon resin coating is not performed, the term "composite structural particles" refers to composite structural particles which have not been subjected to the surface treatment and/or fluorocarbon resin coating.

The resin binder is preferably a thermoplastic resin, a photocurable resin, or a cured resin thereof, and is more preferably a photocurable resin or a cured resin obtained by polymerizing the photocurable resin because particularly high film strength is obtained.

More specific examples of the resin binder include a polyvinyl butyral resin, an epoxy resin, a polyurethane resin, a phenol resin, a polyester resin, an alkyd resin, a polycarbonate resin, a silicone resin, an acrylic resin, and a melamine resin. In a case where a thermoplastic resin is used, a polycarbonate resin is preferably used. In a case where a photocurable resin is used, a cured resin (=polymerized cured product of a polymerizable compound) obtained by polymerizing a compound having two or more radically polymerizable functional groups (hereinafter, also referred to as "radically polymerizable polyfunctional compound" or "polymerizable compound") by irradiation with an active ray such as an ultraviolet ray or an electron beam or the like is preferably used. A polymerized cured product of a polymerizable compound is used as a resin binder because resin binders (polymerizable compounds as a raw material) are connected to each other by a covalent bond at the time of curing to form a strong film quality as an outermost surface layer film. The film thus obtained has a three-dimensional crosslinked structure and can have resistance to discharge and physical scratch resistance, unlike a two-dimensional outermost surface layer obtained from a thermoplastic resin. The above compounds illustrated as the resin binder can be used singly or in combination of two or more kinds thereof.

(Radically Polymerizable Polyfunctional Compound)

The radically polymerizable polyfunctional compound (polymerizable compound) is particularly preferably an acrylic monomer having two or more acryloyl groups ($CH_2{=}CHCO{-}$) or methacryloyl groups ($CH_2{=}CCH_3CO{-}$) as a radically polymerizable functional group or an oligomer thereof because curing is possible with a small amount of light or in a short time. Therefore, the cured resin (polymerized cured product) is preferably an acrylic resin formed from an acrylic monomer or an oligomer thereof.

Examples of the radically polymerizable polyfunctional compound (polymerizable compound) include the following compounds.

[Chemical formula 2]

M1

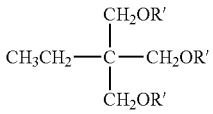

M2

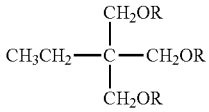

M3

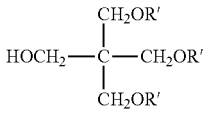

-continued

M4

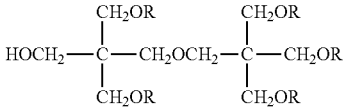

M5

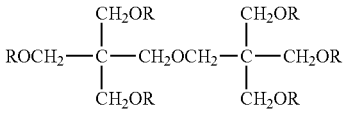

M6

$CH_3CH_2C\text{—}(CH_2OC_3H_6OR)_3$

M7

$CH_3CH_2C\text{—}(CH_2CH_2OR)_3$

[Chemical formula 3]

M8

$R\text{—}(OC_3H_5)_3\text{—}OR$

M9

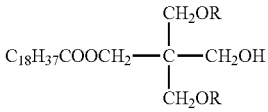

M10

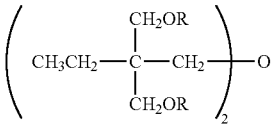

M11

$(ROCH_2)_4\text{—}C$

M12

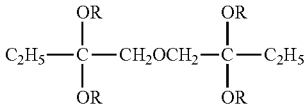

M13

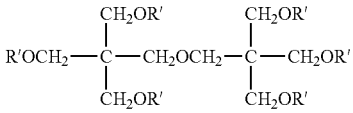

M14

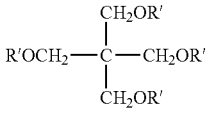

M15

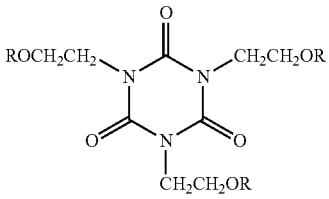

However, in the chemical formulas representing the above exemplified compounds M1 to M15, R represents an acryloyl group ($CH_2{=}CHCO$—), and R' represents a methacryloyl group ($CH_2{=}CCH_3CO$—).

(Polymerization Initiator)

The polymerization initiator is used in a process of manufacturing a cured resin (resin binder) obtained by polymerizing the radically polymerizable polyfunctional compound. The polymerization initiator is a radical polymerization initiator that initiates a polymerization reaction of a radically polymerizable polyfunctional compound, and examples thereof include a thermal polymerization initiator and a photopolymerization initiator.

Examples of a method for polymerizing a radically polymerizable polyfunctional compound include a method utilizing an electron beam cleavage reaction and a method utilizing light or heat in the presence of a radical polymerization initiator.

Examples of the thermal polymerization initiator include: an azo compound such as 2,2'-azobisisobutyronitrile, 2,2'-azobis(2,4-dimethylazobisvaleronitrile), or 2,2'-azobis(2-methylbutyronitrile); and a peroxide such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, or lauroyl peroxide.

Examples of the photopolymerization initiator include: an acetophenone-based or ketal-based photopolymerization initiator such as diethoxyacetophenone, 2,2-dimethoxy-1,2-diphenylethan-1-one, 1-hydroxy-cyclohexyl-phenyl-ketone, 4-(2-hydroxyethoxy) phenyl-(2-hydroxy-2-propyl) ketone, 2-benzyl-2-dimethylamino-1-(4-morpholinophenyl) butanone-1 ("Irgacure 369" (manufactured by BASF Japan)), 2-hydroxy-2-methyl-1-phenylpropan-1-one, 2-methyl-2-morpholino (4-methylthiophenyl) propan-1-one, or 1-phenyl-1,2-propanedione-2-(o-ethoxycarbonyl) oxime; a benzoin ether-based photopolymerization initiator such as benzoin, benzoin methyl ether, benzoin ethyl ether, benzoin isobutyl ether, or benzoin isopropyl ether; a benzophenone-based photopolymerization initiator such as benzophenone, 4-hydroxybenzophenone, methyl o-benzoylbenzoate, 2-benzoyl naphthalene, 4-benzoyl biphenyl, 4-benzoyl phenyl ether, acrylated benzophenone, or 1,4-benzoyl benzene; and a thioxanthone-based photopolymerization initiator such as 2-isopropylthioxanthone, 2-chlorothioxanthone, 2,4-dimethylthioxanthone, 2,4-diethylthioxanthone, or 2,4-dichlorothioxanthone.

Examples of other photopolymerization initiators include ethylanthraquinone, 2,4,6-trimethylbenzoyl diphenylphosphine oxide, 2,4,6-trimethylbenzoylphenyl ethoxyphosphine oxide, bis(2,4,6-trimethylbenzoyl) phenylphosphine oxide ("Irgacure 819" (manufactured by BASF Japan), bis(2,4-dimethoxybenzoyl)-2,4,4-trimethylpentylphosphine oxide, methylphenylglyoxy ester, 9,10-phenanthrene, an acridine-based compound, a triazine-based compound, and an imidazole-based compound. In addition, a compound having a photopolymerization accelerating effect can be used singly or in combination with the above photopolymerization initiators. Examples of the compound having a photopolymerization accelerating effect include triethanolamine, methyldiethanolamine, 4-dimethylaminobenzoic acid ether, isoamyl 4-dimethylaminobenzoate, benzoic acid (2-dimethylamino) ether, and 4,4'-dimethylaminobenzophenone.

As the polymerization initiator, a photopolymerization initiator is preferably used, an alkylphenone-based compound or a phosphine oxide-based compound is more preferably used, and a photopolymerization initiator having an α-hydroxyacetophenone structure or an acylphosphine oxide structure is still more preferably used.

These polymerization initiators may be used singly or in mixture of two or more kinds thereof.

A use ratio of the polymerization initiator is 0.1 to 40 parts by mass, and preferably 0.5 to 20 parts by mass with respect to 100 parts by mass of the radically polymerizable polyfunctional compound.

The outermost surface layer of the photoreceptor according to an embodiment of the present invention may contain a charge transporting material, organic fine particles, lubricant particles, and the like in addition to the composite structural particles and the resin binder as described above. Incidentally, an additive such as the charge transporting material, the organic fine particles, or the lubricant particles is not particularly limited, and a known additive can be used.

[Method for Forming Outermost Surface Layer]

The outermost surface layer of the photoreceptor according to an embodiment of the present invention can be formed by manufacturing an application liquid (application liquid for an outermost surface layer) obtained by mixing composite structural particles and, if necessary, a polymerizable compound (raw material of a cured resin as a resin binder), a polymerization initiator, or the like in a solvent, applying the application liquid onto a charge transporting layer described below, and drying and curing the application liquid.

In the above applying, drying, and curing processes, a reaction between the polymerizable compounds, a reaction between the polymerizable compound and a hydroxy group (reactive group) of the composite structural particles or a polymerizable reactive group of the composite structural particles surface-treated with a surface treatment agent or the like, a reaction between the surface-treated composite structural particles, and the like progress, and the outermost surface layer is formed.

As the solvent used for the application liquid for an outermost surface layer, any solvent can be used as long as being able to dissolve or disperse the composite structural particles and a polymerizable compound (raw material of a cured resin as a resin binder), a polymerization initiator, a charge transporting agent, organic fine particles, and the like added if necessary. Specific examples thereof include methanol, ethanol, n-propyl alcohol, isopropyl alcohol, n-butyl alcohol, t-butyl alcohol, sec-butyl alcohol (2-butanol), benzyl alcohol, toluene, xylene, methylene chloride, methyl ethyl ketone, cyclohexane, ether acetate, butyl acetate, methyl cellosolve, ethyl cellosolve, tetrahydrofuran, 1-dioxane, 1,3-dioxolane, pyridine, and diethylamine, but are not limited thereto. These solvents can be used singly or in combination of two or more kinds thereof.

A method for preparing an application liquid is not particularly limited. It is only required to add composite structural particles and, if necessary, various additives such as a polymerizable compound (raw material of a cured resin as a resin binder) and a polymerization initiator to a solvent and to stir and mix the resulting mixture until the mixture is dissolved or dispersed. The amount of the solvent is not particularly limited, and only needs to be appropriately adjusted such that the application liquid has a viscosity suitable for an application operation.

An application method is not particularly limited, and a known method such as a dip coating method, a spray coating method, a spinner coating method, a bead coating method, a blade coating method, a beam coating method, a slide hopper method, or a circular slide hopper method can be used.

Incidentally, in a case where the above-described photocurable resin binder is added, the application liquid is preferably prepared under light shielding.

The application liquid is applied and then naturally dried or thermally dried to form an applied film. Thereafter, in a case where a polymerizable compound is used, curing is performed by irradiation with an active energy ray to generate a resin component containing a polymerizable compound (in addition, a surface treatment agent or a fluorocarbon resin used for the surface treatment of the composite structural particles) as a monomer component. As the active energy ray, an ultraviolet ray and an electron beam are more preferable, and an ultraviolet ray is still more preferable.

As a light source of the ultraviolet ray, any light source that generates an ultraviolet ray can be used without limitation. Examples of the light source include a low-pressure mercury lamp, a medium-pressure mercury lamp, a high-pressure mercury lamp, an extra high-pressure mercury lamp, a carbon arc lamp, a metal halide lamp, a xenon lamp, and a flash (pulse) xenon lamp. Irradiation conditions vary depending on a lamp, but an irradiation dose of an ultraviolet ray is usually 5 to 500 $mJ/cm^2$, and preferably 5 to 100 $mJ/cm^2$. An output of the light source is preferably 0.1 to 5 kW, and more preferably 0.5 to 3 kW.

An electron beam irradiation device used as an electron beam source is not particularly limited, and in general, a curtain beam type device that is relatively inexpensive and can obtain a large output as an electron beam accelerator for electron beam irradiation is suitably used. An accelerating voltage at the time of irradiation with an electron beam is preferably 100 to 300 kV. An absorption dose is preferably 0.5 to 10 Mrad.

Irradiation time for obtaining a required irradiation dose of an active energy ray is preferably 0.1 seconds to 10 minutes, and more preferably 0.1 seconds to 5 minutes from a viewpoint of operation efficiency.

In the process of forming the outermost surface layer of the photoreceptor, drying can be performed before and after irradiation with an active energy ray or during irradiation with an active energy ray, and the timing of drying can be appropriately selected by combining these.

Drying conditions can be appropriately selected depending on the kind of the solvent, the film thickness, and the like. Drying temperature is preferably 20 to 180° C., and more preferably 80 to 140° C. Drying time is preferably 1 to 200 minutes, and more preferably 5 to 100 minutes.

The film thickness of the outermost surface layer of the photoreceptor is preferably 1 to 10 μm, and more preferably 1.5 to 5 μm.

Hereinafter, the configuration of a part other than the outermost surface layer in the electrophotographic photoreceptor will be described.

In the present invention, the electrophotographic photoreceptor is an electrophotographic photoreceptor configured by causing an organic compound or the like to have at least one of a charge generating function and a charge transporting function indispensable for constituting the electrophotographic photoreceptor, and includes all known photoreceptors such as a photoreceptor constituted by a known organic charge generating material or organic charge transporting material and a photoreceptor in which a charge generating function and a charge transporting function are constituted by a polymer complex.

The photoreceptor according to an embodiment of the present invention has a layer configuration obtained by sequentially laminating a charge generating layer and a charge transporting layer as photosensitive layers on a conductive support and laminating an outermost surface layer on the photosensitive layer. An intermediate layer is preferably disposed between the conductive support and the charge generating layer.

The configuration of a part other than the above-described surface layer in the photoreceptor according to an embodiment of the present invention will be described centering on the layer configuration described above.

<Conductive Support>

As a conductive support used in the present invention, any conductive material can be used. Specific examples thereof include a product obtained by molding a metal such as aluminum, copper, chromium, nickel, zinc, or stainless steel into a drum shape (cylindrical shape) or a sheet shape, a product obtained by laminating a metal foil such as aluminum or copper on a plastic film, a product obtained by vapor-depositing aluminum, indium oxide, tin oxide, or the like on a plastic film, and a metal, a plastic film, paper, and the like having a conductive layer disposed thereon by applying a conductive material alone or together with a binder resin.

<Intermediate Layer>

In the present invention, an intermediate layer having a barrier function and an adhesive function can be disposed between the conductive support and the photosensitive layer. Considering prevention of various faults and the like, it can be said that it is preferable to dispose the intermediate layer.

Such an intermediate layer contains, for example, a binder resin and, if necessary, conductive particles or metal oxide particles.

The binder resin that can be used for the conductive support or the intermediate layer is not particularly limited, and a conventionally known binder resin for a conductive support or an intermediate layer can be used. Examples of the binder resin include casein, polyvinyl alcohol, nitrocellulose, an ethylene-acrylic acid copolymer, a polyamide resin, a polyurethane resin, and gelatin. Among these compounds, an alcohol-soluble polyamide resin is preferable. These binder resins can be used singly or in combination of two or more kinds thereof.

The intermediate layer can contain various conductive particles and metal oxide particles in order to adjust resistance. Examples thereof include various metal oxide particles such as alumina, zinc oxide, titanium oxide, tin oxide, antimony oxide, indium oxide, or bismuth oxide. Examples thereof further include various conductive particles (ultrafine particles) such as indium oxide doped with tin (ITO), tin oxide doped with antimony (ATO), and zirconium oxide. The various kinds of conductive particles and metal oxide particles used for adjusting resistance may be used singly or in combination of two or more kinds thereof. In a case where two or more kinds are mixed, the particles may be in a form of solid solution or fusion.

The various kinds of conductive particles and metal oxide particles used for adjusting resistance have a number average primary particle diameter preferably of 0.3 μm or less, more preferably of 0.1 μm or less.

The content ratio (total amount) of the conductive particles and/or metal oxide particles is preferably 20 to 400 parts by mass, more preferably 50 to 350 parts by mass, and still more preferably 50 to 200 parts by mass with respect to 100 parts by mass of the binder resin in the intermediate layer from a viewpoint of adjusting resistance.

The film thickness of the intermediate layer is preferably 0.1 to 15 μm, and more preferably 0.3 to 10 μm from a viewpoint of adjusting resistance.

The intermediate layer as described above can be formed, for example, by dissolving a binder resin in a known solvent, dispersing conductive particles or metal oxide particles therein if necessary to prepare an application liquid for forming an intermediate layer, applying the application liquid for forming an intermediate layer onto a surface of a conductive support to form an applied film, and drying the applied film.

The solvent used for the application liquid for forming an intermediate layer is not particularly limited, and examples thereof include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichlorethylene, tetrachloroethane, tetrahydrofuran, dioxolane, dioxane, methanol, ethanol, butanol, isopropanol, ethyl acetate, butyl acetate, dimethyl sulfoxide, and methyl cellosolve. Among these solvents, toluene, tetrahydrofuran, dioxolane, and the like are preferably used. These solvents can be used singly or as a mixed solvent of two or more kinds thereof. Among these solvents, it is preferable to use a solvent that disperses the above conductive particles or metal oxide particles well and dissolves a binder resin, particularly a polyamide resin. Specifically, alcohols having 1 to 4 carbon atoms, such as methanol, ethanol, n-propyl alcohol, isopropyl alcohol, n-butyl alcohol, t-butyl alcohol, and sec-butyl alcohol are preferable because of excellent dissolubility for a polyamide resin and excellent application performance. These solvents can be used singly or in combination of two or more kinds thereof. In order to improve storage stability and dispersibility of inorganic particles, the above solvent can be used in combination with a co-solvent. Examples of a co-solvent capable of obtaining a preferable effect include benzyl alcohol, toluene, methylene chloride, cyclohexanone, and tetrahydrofuran.

The concentration of the binder resin in the application liquid for forming an intermediate layer is appropriately selected according to the film thickness of the intermediate layer and a manufacturing rate.

As a method for dispersing the conductive particles or the metal oxide particles, an ultrasonic dispersing machine, a ball mill, a sand grinder, a homomixer, or the like can be used.

Examples of a method for applying the application liquid for forming an intermediate layer is not particularly limited, but examples thereof include a dip application method and a spray coating method.

As a method for drying an applied film, a known drying method can be appropriately selected according to the kind of solvent and the film thickness of an intermediate layer formed, and an applied film is particularly preferably dried thermally.

As described above, the method for forming the intermediate layer is not particularly limited. However, a binder resin is dissolved in the above solvent, and if necessary, conductive particles or metal oxide particles are dispersed therein using a device (dispersing machine) such as an ultrasonic dispersing machine, a ball mill, a sand mill, or a homomixer to prepare an application liquid for forming an intermediate layer, and then the application liquid for forming an intermediate layer is applied onto a conductive support so as to have a desired thickness. Thereafter, the applied layer is dried to complete the intermediate layer.

<Photosensitive Layer>

The photoreceptor according to an embodiment of the present invention has a photosensitive layer, and the photosensitive layer has a charge generating layer and a charge transporting layer. Specifically, the charge generating layer and the charge transporting layer are laminated in order from the side of the conductive support.

[Charge Generating Layer]

The charge generating layer used in the photoreceptor according to an embodiment of the present invention preferably contains a charge generating material and a binder resin (hereinafter, also referred to as a binder resin for a charge generating layer).

Examples of the charge generating material include: an azo raw material such as Sudan Red or Diane Blue; a quinone pigment such as pyrenequinone or anthanthrone; a quinocyanine pigment; a perylene pigment; an indigo pigment such as indigo or thioindigo; a polycyclic quinone pigment such as pyranthrone or diphthaloyl pyrene; and a phthalocyanine pigment such as a titanyl phthalocyanine pigment but are not limited thereto. These charge generating materials can be used singly or in combination of two or more kinds thereof. Among these compounds, a polycyclic quinone pigment and a titanyl phthalocyanine pigment are preferable.

The binder resin for a charge generating layer is not particularly limited, and a known resin can be used. Specific examples thereof include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, a copolymer resin containing two or more of these resins (for example, a vinyl chloride-vinyl acetate copolymer resin or a vinyl chloride-vinyl acetate-maleic anhydride copolymer resin), and a polyvinyl carbazole resin, but are not limited thereto. These binder resins can be used singly or in combination of two or more kinds thereof. A polyvinyl butyral resin is preferable.

A content ratio of the charge generating material in the charge generating layer is preferably 1 to 600 parts by mass, more preferably 20 to 600 parts by mass, and still more preferably 50 to 500 parts by mass with respect to 100 parts by mass of the binder resin for a charge generating layer from a viewpoint that electric resistance of the photoreceptor is suppressed to a low level and an increase in residual potential due to repeated use can be extremely suppressed.

The film thickness of the charge generating layer varies depending on the characteristics of the charge generating material, the characteristics of the binder resin for a charge generating layer, and a content ratio thereof, but is preferably 0.01 to 5 μm, more preferably 0.05 to 3 μm, still more preferably 0.1 to 2 μm, and further still more preferably 0.15 to 1.5 μm.

A method for forming the charge generating layer as described above is not particularly limited. However, for example, a charge generating material is added to a solution obtained by dissolving a binder resin for a charge generating layer in a known solvent, and the charge generating material is dispersed therein using a dispersing machine to prepare an application liquid for forming a charge generating layer. In a case where an intermediate layer is disposed on a conductive support, the application liquid for forming a charge generating layer is applied onto a surface of the intermediate layer (using an applicator so as to have a constant film thickness) to form an applied film and dries the applied film. As the applying method and the drying method, a similar method to the methods exemplified in the section of the outermost surface layer can be adopted. Note that occurrence of image defects can be prevented by filtering foreign matters or aggregates before the application liquid for forming a charge generating layer is applied. The charge generating material may be added singly to the solution as it is or may be added in a form of being dispersed in the binder resin for a charge generating layer. The charge generating layer can also be formed by vacuum vapor deposition of the charge generating material. In this form, it is not particularly necessary to use the binder resin for a charge generating layer.

As a mixing ratio between the binder resin for a charge generating layer and the charge generating material in the application liquid for forming a charge generating layer, the content of the charge generating material is preferably 1 to 600 parts by mass, more preferably 20 to 600 parts by mass, and still more preferably 50 to 500 parts by mass with respect to 100 parts by mass of the binder resin for a charge generating layer. The mixing ratio between the binder resin for a charge generating layer and the charge generating material within the above range is excellent in that the application liquid for forming a charge generating layer can obtain high dispersion stability, that electric resistance in a formed photoreceptor can be suppressed to a low level, and that an increase in residual potential due to repeated use can be extremely suppressed.

As the solvent used for the application liquid for forming a charge generating layer, it is only required to use a solvent capable of dissolving the binder resin for a charge generating layer. Examples thereof include: a ketone-based solvent such as methyl ethyl ketone, methyl isopropyl ketone, methyl isobutyl ketone, cyclohexanone, or acetophenone; an ether-based solvent such as tetrahydrofuran, dioxane, dioxolane, or diglyme; an alcohol-based solvent such as methyl cellosolve, 4-methoxy-4-methyl-2-pentanone, ethyl cellosolve, methanol, ethanol, n-propyl alcohol, isopropyl alcohol, n-butyl alcohol, t-butyl alcohol, sec-butyl alcohol, or butanol; an ester-based solvent thereof such as ethyl acetate or t-butyl acetate; an aromatic solvent such as toluene, xylene, methylene chloride, or chlorobenzene; a halogen-based solvent such as dichloroethane or trichloroethane, cyclohexane, pyridine, and diethylamine, but are not limited thereto. These solvents can be used singly or in combination of two or more kinds thereof.

Examples of a method for dispersing the charge generating material include a method using an ultrasonic dispersing machine, a ball mill, a sand mill, or a homomixer similarly to the method for dispersing conductive particles and metal oxide particles in the application liquid for forming an intermediate layer but are not limited thereto.

Examples of a method for applying the application liquid for forming a charge generating layer and a method for drying an applied film thereof include the same methods as those exemplified as the method for applying the application liquid for forming an intermediate layer and the method for drying an applied film thereof.

[Charge Transporting Layer]

The charge transporting layer used in the photoreceptor according to an embodiment of the present invention preferably contains a charge transporting material and a binder resin (hereinafter, also referred to as a binder resin for a charge transporting layer).

Examples of the charge transporting material in the charge transporting layer include a triphenylamine derivative (for example, 4,4'-dimethyl-4"-(β-phenylstyryl) triphenylamine), a hydrazone compound, a styryl compound, a benzidine compound, and a butadiene compound, but are not limited thereto. The charge transporting materials can be used singly or in combination of two or more kinds thereof. A commercially available product or a synthetic product may be used for the charge transporting material. Examples of a method for synthesizing the charge transporting material include a method for synthesizing a charge transporting material (charge transporting compound) described in JP 2010-26428 A, JP 2010-91707 A, and the like.

The binder resin for a charge transporting layer is not particularly limited, and a known resin can be used. Specific examples thereof include a polycarbonate resin, a polyacrylate resin, a polyester resin, a polystyrene resin, a styrene-acrylonitrile copolymer resin, a polymethacrylate resin, and a styrene-methacrylate copolymer resin, but a polycarbonate resin is preferable. These binder resins for a charge transporting layer can be used singly or in combination of two or more kinds thereof. Polycarbonate A containing bisphenol A (BPA) as a monomer component, polycarbonate Z containing 1,1-bis (4-hydroxyphenyl) cyclohexane (bisphenol Z, BPZ) as a monomer component, a polycarbonate resin containing dimethyl bisphenol A (dimethyl BPA) as a monomer component, a polycarbonate resin containing BPA and dimethyl BPA as monomer components, and the like are more preferable from viewpoints of crack resistance, abrasion resistance, and charging characteristics.

A content ratio of the charge transporting material in the charge transporting layer is preferably 10 to 500 parts by mass, and more preferably 20 to 250 parts by mass with respect to 100 parts by mass of the binder resin for a charge transporting layer from a viewpoint that electric resistance of the photoreceptor is suppressed to a low level and that an increase in residual potential due to repeated use can be extremely suppressed.

The charge transporting layer may further include an antioxidant, an electron conducting agent, a stabilizer, a silicone oil, or the like. For example, an antioxidant disclosed in JP 2000-305291 A is preferable, and electron conducting agents disclosed in JP 50-137543 A and JP 58-76483 A are preferable.

The layer thickness of the charge transporting layer varies depending on characteristics of the charge transporting material, characteristics of the binder resin for a charge transporting layer, the content thereof, and the like, but is preferably 5 to 40 μm, and more preferably 10 to 30 μm.

A method for forming the charge transporting layer as described above is not particularly limited. However, for example, a charge transporting material (CTM) is added to a solution obtained by dissolving a binder resin for a charge transporting layer in a known solvent, and the charge transporting material is dispersed therein using a dispersing machine to prepare an application liquid for forming a charge transporting layer. The charge transporting layer can be formed by applying the application liquid for forming a charge transporting layer onto a surface of the charge generating layer (using an applicator so as to have a constant film thickness) to form an applied film and drying the applied film. As the applying method, a similar method to the methods exemplified in the section of the outermost surface layer can be adopted. As the drying method, a similar method to the methods exemplified in the section of the outermost surface layer can be adopted. Note that occurrence of image defects can be prevented by filtering foreign matters or aggregates before the application liquid for forming a charge transporting layer is applied. The charge transporting material may be added to the solution as it is or may be added in a form of being dispersed in the binder resin for a charge transporting layer. The charge transporting layer can also be formed by vacuum vapor deposition of the charge transporting material. In this form, it is not particularly necessary to use the binder resin for a charge transporting layer.

Examples of the solvent used for the application liquid for forming a charge transporting layer include the same solvents as those used for the application liquid for forming a charge generating layer.

Examples of a method for applying the application liquid for forming a charge transporting layer and a method for drying an applied film thereof include the same methods as those exemplified as the method for applying the application liquid for forming a charge generating layer and the method for drying an applied film thereof.

A mixing ratio of the charge transporting material with respect to the binder resin for a charge transporting layer in the application liquid for forming a charge transporting layer is preferably 10 to 500 parts by mass, and more preferably 20 to 250 parts by mass with respect to 100 parts by mass of the binder resin for a charge transporting layer. The mixing ratio between the binder resin for a charge transporting layer and the charge transporting material within the above range is excellent in that the application liquid for forming a charge transporting layer can obtain high dispersion stability, that electric resistance in a formed photoreceptor can be suppressed to a low level, and that an increase in residual potential due to repeated use can be extremely suppressed.

[Charging Roller (Charger: Roller Charging System)]

Figure 3:
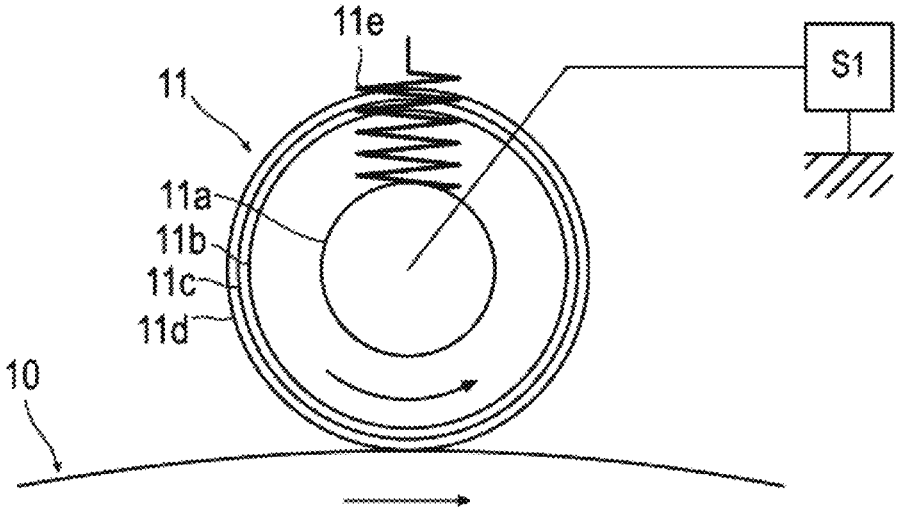
FIG. 3 is an explanatory cross-sectional view exemplifying the configuration of a charging roller in the image forming device illustrated in FIG. 1.

The charging roller 11 is a charger for (negatively) charging a surface of the electrophotographic photoreceptor and is a proximity charging type (including contact type) charger (roller charging system) for applying a charging voltage by being close to (including a form of being in contact with) the surface of the electrophotographic photoreceptor. As a representative embodiment of the charging roller 11 including the charger (roller charging system), for example, as illustrated in FIG. 3, the charging roller 11 obtained by, if necessary, laminating the resistance control layer 11*c* for obtaining highly uniform electric resistance of the charging roller 11 as a whole on a surface of the elastic layer 11*b* for reducing a charging sound and obtaining uniform adhesion to the photoreceptor 10 by imparting elasticity, laminated on a surface of the metal core 11*a*, and laminating a surface layer 11*d* on the resistance control layer 11*c*, is urged in a direction of the photoreceptor 10 by a pressing spring 11*e* and pressed against a surface of the photoreceptor 10 with a predetermined pressing force to form a charging nip portion, and is rotated following rotation of the photoreceptor 10.

The core metal 11*a* is formed of a metal such as iron, copper, stainless steel, aluminum, or nickel, or a product obtained by plating a surface of each of these metals to an extent that conductivity is not impaired in order to obtain an antirust property and scratch resistance. An outer diameter of the core metal 11*a* is, for example, 3 to 20 mm.

The elastic layer 11*b* is formed of, for example, an elastic material such as rubber, including conductive fine particles formed of carbon black, carbon graphite, or the like, or conductive salt fine particles formed of an alkali metal salt, an ammonium salt, or the like. Specific examples of the elastic material include a natural rubber, a synthetic rubber such as an ethylene propylene diene methylene rubber (EPDM), a styrene-butadiene rubber (SBR), a silicone rubber, a urethane rubber, an epichlorohydrin rubber, an isoprene rubber (IR), a butadiene rubber (BR), a nitrile-butadiene rubber (NBR), or a chloroprene rubber (CR), a resin such as a polyamide resin, a polyurethane resin, a silicone resin, or a fluorocarbon resin, and a foam such as a foamed sponge. The magnitude of elasticity can be adjusted by adding a process oil, a plasticizer, or the like to the elastic material.

The volume resistivity of the elastic layer 11*b* is preferably within a range of $1\times10^{1}$ to $1\times10^{10}$ Ω·cm. The layer thickness of the elastic layer 11*b* is preferably within a range of 500 to 5000 μm, and more preferably within a range of 500 to 3000 μm. The volume resistivity of the elastic layer 11*b* is a value measured in accordance with JIS K6911-2006.

The resistance control layer 11*c* is disposed in order to make the charging roller 11 have a uniform electric resistance as a whole, for example, but does not need to be disposed. The resistance control layer 11*c* can be disposed by applying a material having appropriate conductivity or by coating with a tube having appropriate conductivity.

Specific examples of a material constituting the resistance control layer 11*c* include a material obtained by adding a conductive agent such as conductive fine particles formed of carbon black, carbon graphite, or the like; conductive metal oxide fine particles formed of conductive titanium oxide, conductive zinc oxide, conductive tin oxide, or the like; or conductive fine particle formed of an alkali metal salt, an ammonium salt, or the like to a base material such as a resin including a polyamide resin, a polyurethane resin, a fluorocarbon resin, and a silicone resin; or a rubber including an epichlorohydrin rubber, a urethane rubber, a chloroprene rubber, and an acrylonitrile-based rubber.

The volume resistivity of the resistance control layer 11*c* is preferably within a range of $1\times10^{-2}$ to $1\times10^{14}$ Ω·cm, and more preferably within a range of $1\times10^{1}$ to $1\times10^{10}$ Ω·cm. The layer thickness of the resistance control layer 11*c* is preferably within a range of 0.5 to 100 μm, more preferably within a range of 1 to 50 μm, and still more preferably within a range of 1 to 20 μm. The volume resistivity of the resistance control layer 11*c* is a value measured in accordance with JIS K6911-2006.

The surface layer 11*d* is disposed in order to prevent bleeding out of a plasticizer or the like in the elastic layer 11*b* to a surface of the charging roller 11, to obtain a slipping property and smoothness of the surface of the charging roller 11, or to prevent occurrence of leakage even in a case where there is a defect such as a pinhole on the photoreceptor 10, for example. The surface layer 11*d* is disposed by applying a material having appropriate conductivity or by coating with a tube having appropriate conductivity.

In a case where the surface layer 11*d* is disposed by applying a material, specific examples of the material include a material obtained by adding a conductive agent such as conductive fine particles formed of carbon black, carbon graphite, or the like; or conductive metal oxide fine particles formed of conductive titanium oxide, conductive zinc oxide, conductive tin oxide, or the like to a base material such as a resin including a polyamide resin, a polyurethane resin, an acrylic resin, a fluorocarbon resin, and a silicone resin, an epichlorohydrin rubber, a urethane rubber, a chloroprene rubber, or an acrylonitrile-based rubber. Examples of an application method include a dip application method, a roll application method, and a spray application method.

In a case where the surface layer 11*d* is disposed by coating with a tube, specific examples of the tube include a tube obtained by adding the above conductive agent to nylon 12, a tetrafluoroethylene-perfluoroalkyl vinyl ether copolymer resin (PFA), polyvinylidene fluoride, a tetrafluoroethylene-hexafluoropropylene copolymer resin (FEP); or a thermoplastic elastomer such as a polystyrene-based elastomer, a polyolefin-based elastomer, a polyvinyl chloride-based elastomer, a polyurethane-based elastomer, a polyester-based elastomer, or a polyamide-based elastomer and molding the resulting mixture into a tube shape. The tube may be heat-shrinkable or non-heat-shrinkable.

The volume resistivity of the surface layer 11*d* is preferably within a range of $1\times10^{11}$ to $1\times10^{8}$ Ω·cm, and more preferably within a range of $1\times10^{1}$ to $1\times10^{5}$ Ω·cm. The layer thickness of the surface layer 11*d* is preferably within a range of 0.5 to 100 μm, more preferably within a range of 1 to 50 μm, and still more preferably within a range of 1 to 20 μm. The volume resistivity of the surface layer 11*d* is a value measured in accordance with JIS K6911-2006.

The surface layer 11*d* has a surface roughness Rz preferably within a range of 1 to 30 μm, more preferably within a range of 2 to 20 μm, still more preferably within a range of 5 to 10 μm. The surface roughness Rz of the surface layer 11*d* is a value measured in accordance with JIS B0601-2001.

In the charging roller 11 as described above, a charging bias voltage is applied to the core metal 11*a* of the charging roller 11 from a power source S1, and a surface of the photoreceptor 10 is thereby charged to a predetermined potential of a predetermined polarity. Here, the charging bias voltage may be, for example, only a DC voltage, but is preferably an oscillating voltage in which an AC voltage is superimposed on a DC voltage because of excellent uniformity in charging. The charging bias voltage can be, for example, about −2.5 to −1.5 kV.

Examples of charging conditions with the charging roller 11 illustrated in FIG. 3 include a sinusoidal wave in which a DC voltage (Vdc) forming a charging bias voltage is −500 V, an AC voltage (Vac) has a frequency of 1000 Hz, and a peak-to-peak voltage is 1300 V. By applying this charging bias voltage, the surface of the photoreceptor 10 is uniformly charged to −500 V.

The charging roller 11 has a length based on the length in a longitudinal direction of the photoreceptor 10, and the length in the longitudinal direction can be, for example, 320 mm.

In this image forming device, the photoreceptor 10 is rotationally driven, and the surface of the photoreceptor 10 is uniformly charged to a predetermined potential by the charging roller 11 in a state where a charging bias voltage is applied from the power source S1.

Subsequently, the uniformly charged photoreceptor 10 is exposed by the exposer 12 to form an electrostatic latent image, and the electrostatic latent image is developed by the developer 13 to form a toner image. The toner image formed on the photoreceptor 10 is transferred by the transferer 14 onto the transfer material P conveyed at the timing, separated from the photoreceptor 10 by a separator (not illustrated), and fixed in the fixer 17 to form a visible image.

A toner or the like remaining on the photoreceptor 10 is removed by the cleaning blade 18*a* of the cleaner 18, and the removed toner or the like is stored in a storage 18*b*.

The image forming device according to an embodiment of the present invention is not limited to the device having the above-described configuration and may be a color image forming device having a configuration in which image forming units relating to a plurality of photoreceptors are disposed along an intermediate transfer body.

In such a color image forming device including image forming units relating to a plurality of photoreceptors, each of the plurality of photoreceptors is preferably constituted by the above photoreceptor. However, if at least one of the plurality of photoreceptors is constituted by the above photoreceptor, it is possible to suppress discharge deterioration in a case where (negative) charging is performed by a proximity charging type charger (during roller charging), to obtain high abrasion resistance in the photoreceptor, and to form a good image (high image stability can be obtained in an image formed).

{Toner and Developer}

A toner used in the image forming device according to an embodiment of the present invention is a (negatively) charged toner. The toner used in the image forming device according to an embodiment of the present invention may be a pulverization toner or a polymerization toner. However, in the image forming device according to an embodiment of the present invention, a polymerization toner manufactured by a polymerization method is preferably used from a viewpoint of obtaining a high-quality image.

The polymerization toner means a toner obtained by performing generation of a binder resin forming a toner and formation of a toner particle shape in parallel by polymerization of a raw material monomer for obtaining the binder resin and, if necessary, a subsequent chemical treatment.

More specifically, the polymerization toner means a toner formed through a step of obtaining resin fine particles by a polymerization reaction such as suspension polymerization or emulsion polymerization, and a step of fusing resin fine particles performed thereafter, if necessary.

The volume average particle diameter of a toner, that is, the 50% volume particle diameter (Dv 50) is preferably 2 to 9 μm, and more preferably 3 to 7 μm. By setting the volume average particle diameter within this range, it is possible to increase resolution. Furthermore, by combination with the above range, it is possible to reduce the abundance of a toner having a fine particle diameter even when the toner is a small particle diameter toner, to improve reproducibility of a dot image over a long period of time, and to form a stable image having good sharpness.

The toner according to an embodiment of the present invention may be used alone as a one-component developer or may be mixed with a carrier to be used as a two-component developer.

In a case where the toner is used as a one-component developer, examples thereof include a nonmagnetic one-component developer and a magnetic one-component developer containing magnetic particles of about 0.1 to 0.5 μm in the toner, and both of these can be used.

In a case where the toner is mixed with a carrier to be used as a two-component developer, a conventionally known material, for example, a metal such as iron, ferrite, or magnetite, or alloys of these metals with a metal such as aluminum or lead can be used. Ferrite particles are particularly preferable. The magnetic particles have a volume average particle diameter preferably of 15 to 100 μm, more preferably of 25 to 80 μm.

The volume average particle diameter of the toner or the carrier can be typically measured with a laser diffraction type particle size distribution measurement apparatus "HELOS" (manufactured by SYMPATEC Gmbh) equipped with a wet type dispersing machine.

The carrier is preferably a carrier in which magnetic particles are further coated with a resin or a so-called resin dispersion type carrier in which magnetic particles are dispersed in a resin. The composition of a resin for coating is not particularly limited, but examples thereof include an olefin-based resin, a styrene-based resin, a styrene acrylic resin, a silicone-based resin, an ester-based resin, and a fluorine-containing polymer-based resin. A resin for constituting the resin dispersion type carrier is not particularly limited, and a known resin can be used. Examples thereof include a styrene acrylic resin, a polyester resin, a fluorine-based resin, and a phenol resin.

The embodiment of the present invention has been specifically described above, but the embodiment of the present invention is not limited to the above examples, and various modifications can be made thereto.

EXAMPLES

Hereinafter, specific Examples of the present invention will be described, but the present invention is not limited thereto.

[Manufacture of Composite Structural Particles 1]

In 3.5 L of water, 200 g of barium sulfate particles (average particle diameter of primary particles: 80 nm) as inorganic particles (core) was dispersed until coarse particles of the barium sulfate particles disappeared, and a slurry was obtained. To the slurry, 384 g of sodium stannate ($Na_2SnO_3$) having a tin content of 41% by mass was added, and sodium stannate was dissolved therein to obtain a mixed slurry. To the mixed slurry, 20% dilute sulfuric acid was added over 98 minutes, and the pH of the mixed slurry was adjusted to 2.5. The obtained reaction liquid (reaction slurry) was cleaned with warm water. After completion of cleaning, dewatering filtration was performed to collect a cake. Subsequently, the obtained cake was allowed to stand for 15 hours in an atmosphere at 150° C. to be dried. Thereafter, the obtained dry cake was disintegrated and fired at 450° C. for 30 minutes while a nitrogen gas containing 2% by volume of hydrogen was flowing, and powder of composite structural particles 1 coated with conductive tin oxide that had not been subjected to a surface treatment was obtained.

The average particle diameter of primary particles of the composite structural particles 1 that had not been subjected to a surface treatment as manufactured above was 100 nm as measured by volume-based particle diameter measurement of particles by a laser diffraction method. Note that composite structural particles of the following Examples and Comparative Examples were also measured by a similar measuring method.

Methanol and 2.5 g (2.5 parts by mass) of a methacryloyl group-containing silane coupling agent (KBM-503 manufactured by Shin-Etsu Chemical Co., Ltd.) were mixed to prepare 20 ml of a surface treatment agent. 100 g (100 parts by mass) of the powder of the composite structural particles 1 coated with conductive tin oxide obtained above was stirred at a high speed in a substantially horizontal direction in a chamber of a mixer, the surface treatment agent was dropped into the chamber, and stirring was continued for one minute. Thereafter, the powder was taken out from the chamber, heated to 100° C., and dried to obtain powder of the composite structural particles 1 coated with conductive tin oxide that had been subjected to a surface treatment with a methacryloyl group-containing silane coupling agent.

Furthermore, 50 g (50 parts by mass) of the composite structural particle 1 coated with conductive tin oxide thus obtained was mixed with 390 g of 2-butanol and dispersed for two hours using an ultrasonic dispersing machine. To the dispersion, 75 g (solid content: 1.5 parts by mass) of a fluorocarbon resin-containing surface treatment agent (Novec (registered trademark) 2702 manufactured by 3M Company, solid content concentration: 2% by mass) was added and further dispersed therein for 30 minutes. The dispersion was dried at room temperature to remove the solvent. The obtained powder was heated and dried at 80° C. for 60 minutes to obtain the composite structural particles 1 coated with conductive tin oxide that had been subjected to surface treatment with a methacryloyl group-containing silane coupling agent and a fluorocarbon resin.

An "L* value" as a numerical value expressed by a CIE 1976 (L*a*b*) colorimetric system using a spectral color difference meter SE600 manufactured by Nippon Denshoku Industries Co., Ltd. was taken as an L value of the composite structural particles 1 manufactured above, and the result was 81. Note that L values of composite structural particles of the following Examples and Comparative Examples were also measured by a similar measuring method.

[Manufacture of Composite Structural Particles 2]

Composite structural particles 2 were manufactured similarly except that silicon dioxide particles (average particle diameter of primary particles: 80 nm) were used in place of the barium sulfate particles as inorganic particles (core) in manufacture of the composite structural particles 1.

The average particle diameter of primary particles of the composite structural particles 2 thus manufactured was 100 nm, and an L value thereof was 88.

[Manufacture of Composite Structural Particles 3]

Composite structural particles 3 were manufactured similarly except that barium sulfate particles (average particle diameter of primary particles: 50 μm) were used as inorganic particles (core) and that the treatment amount with the silane coupling agent was changed according to Table 1 in manufacture of the composite structural particles 1.

The average particle diameter of primary particles of the composite structural particles 3 thus manufactured was 70 nm, and an L value thereof was 81.

[Manufacture of Composite Structural Particles 4]

Composite structural particles 4 were manufactured similarly except that aluminum dioxide particles (average particle diameter of primary particles: 80 nm) were used in place of the barium sulfate particles as inorganic particles (core) in manufacture of the composite structural particles 1.

The average particle diameter of primary particles of the composite structural particles 4 thus manufactured was 100 nm, and an L value thereof was 85.

[Manufacture of Composite Structural Particles 5]

Composite structural particles 5 were manufactured similarly except that the surface treatment with the silane coupling agent was not performed in manufacture of the composite structural particles 1.

The average particle diameter of primary particles of the composite structural particles 5 thus manufactured was 100 nm, and an L value thereof was 81.

[Manufacture of Composite Structural Particles 6]

Composite structural particles 6 were manufactured similarly except that barium sulfate particles (average particle diameter of primary particles: 15 nm) were used as inorganic particles (core) in manufacture of the composite structural particles 1.

The average particle diameter of primary particles of the composite structural particles 6 thus manufactured was 35 nm, and an L value thereof was 85.

[Manufacture of Composite Structural Particles 7]

Composite structural particles 7 were manufactured similarly except that the surface treatment with the fluorocarbon resin-containing surface treatment agent was not performed in manufacture of the composite structural particles 1.

The average particle diameter of primary particles of the composite structural particles 7 thus manufactured was 100 nm, and an L value thereof was 81.

[Manufacture of Composite Structural Particles 8]

Composite structural particles 8 were manufactured similarly except that the amount of hydrogen was changed from 2% by volume to 0% by volume (that is, hydrogen was not contained) in manufacture of the composite structural particles 1.

The average particle diameter of primary particles of the composite structural particles 8 thus manufactured was 100 nm, and an L value thereof was 65.

[Manufacture of Composite Structural Particles 9]

Composite structural particles 9 were manufactured similarly except that the amount of hydrogen was changed from 2% by volume to 5% by volume and that the treatment amount with the silane coupling agent was changed according to Table 1 in manufacture of the composite structural particles 1.

The average particle diameter of primary particles of the composite structural particles 9 thus manufactured was 100 nm, and an L value thereof was 96.

[Manufacture of Composite Structural Particles 10]

Composite structural particles 10 were manufactured similarly except that barium sulfate particles (average particle diameter of primary particles: 300 nm) were used as inorganic particles (core) in manufacture of the composite structural particles 1.

The average particle diameter of primary particles of the composite structural particles 10 thus manufactured was 320 nm, and an L value thereof was 82.

Example 1 Manufacture of Photoreceptor 1

(1) Manufacture of Conductive Support

A surface of a drum-shaped aluminum support (outer diameter: 30 mm, length: 360 mm) was cut to manufacture a conductive support [1] having a surface roughness Rz of 1.5 (μm).

(2) Formation of Intermediate Layer

To 1700 parts by mass of a mixed solvent of ethanol/n-propyl alcohol/tetrahydrofuran (volume ratio 45/20/35), 100 parts by mass of a binder resin for an intermediate layer: polyamide resin "CM8000" (manufactured by Toray Industries, Inc.) was added, and the resulting mixture was stirred and mixed at 20° C. To this solution, 120 parts by mass of titanium oxide particles "SMT500SAS" (manufactured by Tayca Corporation) and 160 parts by mass of titanium oxide particles "SMT150MK" (manufactured by Tayca Corporation) were added and dispersed therein by a bead mill with a mill residence time of 5 hours. Then, this solution was allowed to stand all day and night and then filtered to obtain an application liquid for forming an intermediate layer. Filtration was performed under a pressure of 50 kPa using a rigid mesh filter (manufactured by Nihon Pall Ltd.) having a nominal filtration accuracy of 5 μm as a filtration filter. The application liquid for forming an intermediate layer thus obtained was applied onto an outer peripheral surface of the cleaned conductive support [1] by a dip application method and dried at 120° C. for 30 minutes to form an intermediate layer [1] having a dry thickness of 2 μm.

(3) Formation of Charge Generating Layer

The following raw materials were dispersed for 10 hours using a sand mill as a dispersing machine to prepare an application liquid [1] for forming a charge generating layer.

Charge generating material: 20 parts by mass of titanyl phthalocyanine pigment (having a maximum diffraction peak at least at a position of 27.3° in Cu-Ku characteristic X-ray diffraction spectrum measurement)

Binder resin for charge generating layer: 10 parts by mass of polyvinyl butyral resin "#6000-C" (manufactured by Denka)

Solvent: 700 parts by mass of t-butyl acetate

Solvent: 300 parts by mass of 4-methoxy-4-methyl-2-pentanone

The application liquid [1] for forming a charge generating layer was applied onto the intermediate layer [1] by a dip application method to form an applied film, thus forming a charge generating layer [1] having a layer thickness of 0.3 μm.

(4) Formation of Charge Transporting Layer

The following raw materials were mixed and dissolved to prepare an application liquid [1] for forming a charge transporting layer.

Charge transporting material: 225 parts by mass of 4,4'-dimethyl-4"-(3-phenylstyryl) triphenylamine)

Binder resin for charge transporting layer: 300 parts by mass of polycarbonate resin "Z300" (manufactured by Mitsubishi Gas Chemical Company, Inc.)

Solvent: 1600 parts by mass of THF

Solvent: 400 parts by mass of toluene 6 parts by mass of antioxidant (BHT)

1 part by mass of silicone oil "KF-96" (manufactured by Shin-Etsu Chemical Co., Ltd.)

The application liquid [1] for forming a charge transporting layer was applied onto the charge generating layer [1] by a dip application method to form an applied film, and the applied film was dried at 120° C. for 70 minutes to form a charge transporting layer [1] having a layer thickness of 20 μm.

(5) Formation of Outermost Surface Layer

Under light shielding, 100 parts by mass of the composite structural particles 1 manufactured above, 100 parts by mass of a radically polymerizable polyfunctional compound: trimethylolpropane trimethacrylate (manufactured by Sartomer Company), 400 parts by mass of a solvent: 2-butanol, and 40 parts by mass of a solvent:THF (tetrahydrofuran) were mixed and dispersed for five hours using a sand mill as a dispersing machine. Thereafter, 10 parts by mass of a polymerization initiator: Irgacure 819 (manufactured by BASF) was added thereto and stirred and dissolved therein under light shielding to prepare an application liquid [1] for forming an outermost surface layer. This application liquid [1] for forming an outermost surface layer was applied onto the charge transporting layer [1] using a circular slide hopper applicator to form an applied film and irradiated with an ultraviolet ray for one minute using a metal halide lamp to form an outermost surface layer [1] having a dry film thickness of 3.0 μm.

In this manner, the photoreceptor 1 was manufactured.

Example 2 Manufacture of Photoreceptor 2

A photoreceptor 2 was manufactured similarly except that composite structural particles 2 were used in place of the composite structural particles 1 in manufacture of the photoreceptor 1.

Example 3 Manufacture of Photoreceptor 3

A photoreceptor 3 was manufactured similarly except that composite structural particles 3 were used in place of the composite structural particles 1 in manufacture of the photoreceptor 1.

Example 4 Manufacture of Photoreceptor 4

A photoreceptor 4 was manufactured similarly except that the addition amount of the composite structural particles 1 was changed to 70 parts by mass in manufacture of the photoreceptor 1.

Example 5 Manufacture of Photoreceptor 5

A photoreceptor 5 was manufactured similarly except that the addition amount of the composite structural particles 1 was changed to 200 parts by mass in manufacture of the photoreceptor 1.

Example 6 Manufacture of Photoreceptor 6

A photoreceptor 6 was manufactured similarly except that composite structural particles 4 were used in place of the composite structural particles 1 in manufacture of the photoreceptor 1.

Example 7 Manufacture of Photoreceptor 7

A photoreceptor 7 was manufactured similarly except that composite structural particles 5 were used in place of the composite structural particles 1 in manufacture of the photoreceptor 1.

Example 8 Manufacture of Photoreceptor 8

A photoreceptor 8 was manufactured similarly except that composite structural particles 6 were used in place of the composite structural particles 1 in manufacture of the photoreceptor 1.

Example 9 Manufacture of Photoreceptor 9

A photoreceptor 9 was manufactured similarly except that composite structural particles 7 were used in place of the composite structural particles 1 in manufacture of the photoreceptor 1.

Comparative Example 1 Manufacture of Photoreceptor 10

A photoreceptor 10 was manufactured similarly except that composite structural particles 8 were used in place of the composite structural particles 1 in manufacture of the photoreceptor 1.

Comparative Example 2 Manufacture of Photoreceptor 11

A photoreceptor 11 was manufactured similarly except that composite structural particles 9 were used in place of the composite structural particles 1 in manufacture of the photoreceptor 1.

Comparative Example 3 Manufacture of Photoreceptor 12

A photoreceptor 12 was manufactured similarly except that composite structural particles 10 were used in place of the composite structural particles 1 in manufacture of the photoreceptor 1.

The configurations of the photoreceptors 1 to 12 manufactured in Examples 1 to 9 and Comparative Examples 1 to 3 are illustrated in the following Table 1.

<Evaluation>

(1) Cleaning Performance

Using bizhub (registered trademark) C554 manufactured by Konica Minolta Co., Ltd., under conditions of room temperature of 23° C. and humidity of 50% RH, the numbers of deposits on a surface (within a range of 2 cm×10 cm) of a photoreceptor was visually evaluated before and after 10,000 band-shaped chart sheets with a printing ratio of 100% were actually photographed at a position of Bk (black toner). Evaluation criteria are as follows. Evaluation results are illustrated in the following Table 1.

Evaluation criteria of cleaning performance:

⊙: There is no deposit (very good).

○: The number of deposits is 1 or more and less than 5 (good).

Δ: The number of deposits is 5 or more and less than 10 (there is no practical problem).

x: The number of deposits is 10 or more (practically problematic).

(2) Electrical Characteristics

Using bizhub (registered trademark) C368 manufactured by Konica Minolta Co., Ltd., under condition of room temperature of 23° C. and humidity of 50% RH, an initial potential was set to 600±30 V, a surface potential of each photoreceptor after exposure was measured, and evaluation was performed according to the following evaluation criteria. Evaluation results are illustrated in Table 1.

Evaluation criteria of electrical characteristics:

⊙: A surface potential after exposure is less than 60 V (very good).

○: A surface potential after exposure is 60 V or more and less than 90 V (good).

Δ: A surface potential after exposure is 90 V or more and less than 120 V (there is no practical problem).

x: A surface potential after exposure is 120 V or more (practically problematic).

(3) HH (High Temperature and High Humidity) Image Blur

Using bizhub (registered trademark) C368 manufactured by Konica Minolta Co., Ltd., under conditions of room temperature of 30° C. and humidity of 80% RH, 2000 character chart sheets with a printing ratio of 5 wt % were output at a position of Bk and allowed to stand under the same conditions for 15 hours. After the sheets were allowed to stand, a state of formation of dots was evaluated according to the following evaluation criteria using an optical microscope when 20 sheets of A3 were continuously printed with halftone. Evaluation results are illustrated in Table 1.

⊙: Dots are formed on the first to fourth sheets (very good).

○: Dots are formed on the fifth to ninth sheets (good).

Δ: Dots are formed on the 10th to 19th sheets (there is no practical problem).

x: Dots are not formed on the 20th sheet (practically problematic).

TABLE 1

| | | Composite structural particles | | | | | | | |
|---|---|---|---|---|---|---|---|---|---|
| | | | | Inorganic particles (core) | | Silane coupling agent (surface treatment agent) | | Fluorocarbon resin treatment | |
| | Photoreceptor No. | No. | Particle diameter [1] (nm) | Kind | Particle diameter [2] (nm) | Kind | Treatment amount [5] (parts by mass) | Kind | Treatment amount [7] (parts by mass) |
| Example 1 | 1 | 1 | 100 | $BaSO_4$ | 80 | KBM-503[3] | 2.5 | Novec2702[6] | 3 |
| Example 2 | 2 | 2 | 100 | $SiO_2$ | 80 | KBM-503 | 2.5 | Novec2702 | 3 |
| Example 3 | 3 | 3 | 70 | $BaSO_4$ | 50 | KBM-503 | 1 | Novec2702 | 3 |
| Example 4 | 4 | 1 | 100 | $BaSO_4$ | 80 | KBM-503 | 2.5 | Novec2702 | 3 |
| Example 5 | 5 | 1 | 100 | $BaSO_4$ | 80 | KBM-503 | 2.5 | Novec2702 | 3 |
| Example 6 | 6 | 4 | 100 | $Al_2O_3$ | 80 | KBM-503 | 2.5 | Novec2702 | 3 |
| Example 7 | 7 | 5 | 100 | $BaSO_4$ | 80 | —[4] | — | Novec2702 | 3 |
| Example 8 | 8 | 6 | 35 | $BaSO_4$ | 15 | KBM-503 | 2.5 | Novec2702 | 3 |
| Example 9 | 9 | 7 | 100 | $BaSO_4$ | 80 | KBM-503 | 2.5 | — | — |
| Comparative Example 1 | 10 | 8 | 100 | $BaSO_4$ | 80 | KBM-503 | 2.5 | Novec2702 | 3 |
| Comparative Example 2 | 11 | 9 | 100 | $BaSO_4$ | 80 | KBM-503 | 3 | Novec2702 | 3 |
| Comparative Example 3 | 12 | 10 | 320 | $BaSO_4$ | 300 | KBM-503 | 2.5 | Novec2702 | 3 |

| | Composite structural particles | | | Evaluation item | | |
|---|---|---|---|---|---|---|
| | L value | Volume resistivity (Ω · cm) | Addition amount [8] (parts by mass) | Cleaning performance | Electrical characteristics | Image blur |
| Example 1 | 81 | $6.8 \times 10^3$ | 100 | ⊙ | ⊙ | ○ |
| Example 2 | 88 | $5.6 \times 10^6$ | 100 | ○ | ⊙ | ○ |
| Example 3 | 81 | $2.7 \times 10^4$ | 100 | ○ | ○ | Δ |
| Example 4 | 81 | $6.8 \times 10^3$ | 70 | ○ | Δ | ⊙ |
| Example 5 | 81 | $6.8 \times 10^3$ | 200 | ⊙ | ⊙ | Δ |
| Example 6 | 85 | $4.4 \times 10^6$ | 100 | ⊙ | Δ | ○ |
| Example 7 | 81 | $6.8 \times 10^3$ | 200 | Δ | ⊙ | ⊙ |

TABLE 1-continued

| | | | | | | |
|---|---|---|---|---|---|---|
| Example 8 | 85 | $1.2 \times 10^6$ | 100 | ○ | ○ | ○ |
| Example 9 | 81 | $6.8 \times 10^3$ | 100 | Δ | ⊙ | Δ |
| Comparative Example 1 | 65 | $5.8 \times 10^1$ | 100 | Δ | ○ | X |
| Comparative Example 2 | 96 | $4.3 \times 10^8$ | 100 | Δ | X | ⊙ |
| Comparative Example 3 | 82 | $4.2 \times 10^1$ | 100 | X | X | X |

Note:

1) "Particle diameter" indicates an average particle diameter of primary particles of composite structural particles.

2) "Particle diameter" indicates an average particle diameter of primary particles of inorganic particles (core).

3) "KBM-503" indicates 3-methacryloxypropyl triethoxysilane manufactured by Shin-Etsu Chemical Co., Ltd.

4) " —" indicates not added (not blended).

5) "Treatment amount" indicates the mount of a silane coupling agent (surface treatment agent) used with respect to 100 parts by mass of inorganic particles (core).

6) "Novec 2702" indicates a fluorine-based coating agent manufactured by 3M Company, having a solid content concentration of 2% by mass.

7) "Treatment amount" indicates the mount of the solid content of a fluorocarbon resin used with respect to 100 parts by mass of inorganic particles (core).

8) "Addition amount" indicates the mount of composite structural particles used for forming an outermost surface layer.

The results in Table 1 indicate that the photoreceptors 1 to 9 of Examples 1 to 9 have acquired good evaluation in electrical characteristics and image blur. In addition, the photoreceptors 1 to 9 according to an embodiment of the present invention also exhibit good cleaning performance.

Meanwhile, the photoreceptors of Comparative Examples 1 to 3 have a problem in one or more of cleaning performance, electrical characteristics, and image blur.

Although embodiments of the present invention have been described and illustrated in detail, the disclosed embodiments are made for purposes of illustration and example only and not limitation. The scope of the present invention should be interpreted by terms of the appended claims.

What is claimed is:

1. An electrophotographic photoreceptor having a charge generating layer, a charge transporting layer, and an outermost surface layer laminated in this order on a conductive support, wherein the outermost surface layer contains composite structural particles obtained by coating inorganic particles with oxygen-deficient conductive tin oxide, the composite structural particles are further coated with a fluorocarbon resin, and the composite structural particles have an L value of 80 to 95, and primary particles thereof have an average particle diameter of 35 to 200 nm.

2. The electrophotographic photoreceptor according to claim 1, wherein the inorganic particles are formed of any one selected from the group consisting of BaSO4, SiO2, and Al2O3.

3. The electrophotographic photoreceptor according to claim 1, wherein the composite structural particles have a volume resistivity of $10^3$ to $10^7$ Ω·cm.

4. The electrophotographic photoreceptor according to claim 1, wherein the composite structural particles are surface-treated with a silane coupling agent containing an acryloyl group or a methacryloyl group.

5. The electrophotographic photoreceptor according to claim 1, wherein the outermost surface layer further contains a resin binder, and the content of the composite structural particles is within a range of 50 to 250 parts by mass with respect to 100 parts by mass of the resin binder.

6. The electrophotographic photoreceptor according to claim 5, wherein the resin binder is a polymerized cured product of a polymerizable compound.

7. An image forming device comprising:

the electrophotographic photoreceptor according to claim 1;

a charger that charges a surface of the electrophotographic photoreceptor;

an exposer that irradiates the charged surface of the electrophotographic photoreceptor with light to form an electrostatic latent image;

a developer that supplies a toner to the electrophotographic photoreceptor on which the electrostatic latent image is formed to form a toner image; and a transferer that transfers the toner image on the surface of the electrophotographic photoreceptor onto a recording medium, wherein the charger is a proximity charging type charger that applies a charging voltage by being close to the surface of the electrophotographic photoreceptor.

* * * * *